US010483035B2

(12) United States Patent
Leipold et al.

(10) Patent No.: US 10,483,035 B2
(45) Date of Patent: Nov. 19, 2019

(54) SUBSTRATES WITH INTEGRATED THREE DIMENSIONAL SOLENOID INDUCTORS

(71) Applicant: Qorvo US, Inc., Greensboro, NC (US)

(72) Inventors: Dirk Robert Walter Leipold, San Jose, CA (US); George Maxim, Saratoga, CA (US); John August Orlowski, Summerfield, NC (US); Baker Scott, San Jose, CA (US)

(73) Assignee: Qorvo US, Inc., Greensboro, NC (US)

( * ) Notice: Subject to any disclaimer, the term of this patent is extended or adjusted under 35 U.S.C. 154(b) by 142 days.

(21) Appl. No.: 15/251,647

(22) Filed: Aug. 30, 2016

(65) Prior Publication Data

US 2017/0084378 A1 Mar. 23, 2017

Related U.S. Application Data

(60) Provisional application No. 62/221,176, filed on Sep. 21, 2015.

(51) Int. Cl.
*H01F 17/00* (2006.01)
*H01F 41/04* (2006.01)

(52) U.S. Cl.
CPC ..... *H01F 41/042* (2013.01); *H01F 17/0013* (2013.01); *H01F 2017/002* (2013.01)

(58) Field of Classification Search
CPC ..... H01F 17/0013; H01F 17/0006; H01F 17/0033; H01F 27/2804; H01F 2027/2809; H01F 2017/002; H01F 2017/004; H01F 41/041; H01F 41/042
USPC ..... 336/200, 223, 233
See application file for complete search history.

(56) References Cited

U.S. PATENT DOCUMENTS 9,196,406 B2 11/2015 Leipold et al.
2005/0150106 A1 7/2005 Long et al.
2007/0222549 A1* 9/2007 Lim ..... H01F 17/0033 336/200

(Continued)

FOREIGN PATENT DOCUMENTS

JP 2009277972 A * 11/2009

OTHER PUBLICATIONS

Non-Final Office Action for U.S. Appl. No. 15/251,674, dated Jan. 25, 2018, 10 pages.

(Continued)

*Primary Examiner* — Mang Tin Bik Lian
(74) *Attorney, Agent, or Firm* — Withrow & Terranova, P.L.L.C.

(57) ABSTRACT

This disclosure relates generally to substrates having three dimensional (3D) inductors and methods of manufacturing the same. In one embodiment, the 3D inductor is a solenoid inductor where the exterior edge contour of the winding ends is substantially the same and substantially aligned with the exterior edge contour of the exterior edge contour of conductive vias that connect the windings. In this manner, there is no overhang between the windings and the conductive vias. In another embodiment of the 3D inductor, via columns connect connector plates. The via column attachment surfaces of each of the conductive vias in each of the columns is the same and substantially aligned. In this manner, carrier pads are not needed and there is no overhand between the conductive vias.

13 Claims, 15 Drawing Sheets

(56) References Cited

U.S. PATENT DOCUMENTS

| | | | | |
|---|---|---|---|---|
| 2010/0194513 | A1* | 8/2010 | Ozawa | H01F 17/0013 336/200 |
| 2014/0138792 | A1* | 5/2014 | Lo | H01L 23/645 257/531 |
| 2014/0266544 | A1 | 9/2014 | Leipold et al. | |
| 2015/0187486 | A1* | 7/2015 | Lim | H01F 17/0013 336/192 |
| 2015/0340148 | A1* | 11/2015 | Landgraf | H01F 27/2804 336/200 |
| 2016/0163451 | A1* | 6/2016 | Wang | H01F 41/042 336/192 |

OTHER PUBLICATIONS

Author Unknown, "IPC-A-610D: Acceptability of Electronic Assemblies," IPC, 2nd Proposed Standard for Ballot, Nov. 2004, 392 pages.

Final Office Action for U.S. Appl. No. 15/251,674, dated Jun. 28, 2018, 9 pages.

Non-Final Office Action for U.S. Appl. No. 15/251,674, dated Feb. 21, 2019, 10 pages.

* cited by examiner

SUBSTRATES WITH INTEGRATED THREE DIMENSIONAL SOLENOID INDUCTORS

RELATED APPLICATIONS

This application claims the benefit of provisional patent application Ser. No. 62/221,176, filed Sep. 21, 2015, the disclosure of which is hereby incorporated herein by reference in its entirety.

FIELD OF THE DISCLOSURE

This disclosure relates generally to substrates having three dimensional (3D) inductors and methods of manufacturing the same.

BACKGROUND

Printed circuit boards (PCBs) are substrates often used to mount electronic components housed within integrated circuit (IC) packages. For example, a semiconductor die is often mounted on a PCB and then covered with an overmold in order to protect the semiconductor die. Traditional PCBs often have a substrate body formed from a laminate. The substrate body is typically formed from a stack of substrate layers formed from a laminate. To connect the input and output structures of the semiconductor die to other electronic components within the IC package and/or to input and output structures of the IC package accessible externally from the IC package, a conductive structure is often integrated into the substrate body. The conductive structure typically has metallic layers formed horizontally between the substrate layers and/or on a substrate surface. These metallic layers are shaped to form conducting structures, such as traces, terminals, connections pads, and the like to connect electronic components within the IC package and/or the input and output structures of the IC package to the electronic components.

A vertical interconnect access structure (via) is often provided in the conductive structure to extend vertically and through a substrate layer. One of the problems with traditional laminate technology used to form a via is that the via can often be partially misaligned, thereby resulting in unintentional connections, noise, and shorts. To ameliorate this problem, the conductive structure being connected by the via may be formed so as to have a larger footprint than the via, thereby preventing unintentional connections and shorts due to misalignments.

FIG. 1 illustrates one embodiment of a PCB 10 having a substrate body 12 and a conductive structure 14 integrated into the substrate body 12. The substrate body 12 is made from a laminate. The substrate body 12 is formed from a stack of substrate layers 16. The conductive structure 14 is formed from conductive layers 18 and conductive vias 20 that extend through the substrate layers 16 to provide connections between the conductive layers 18. Note that the conductive vias 20 shown in FIG. 1 are formed simply as a conductive post.

As shown in FIG. 1, the conductive structure 14 is shaped to provide a three dimensional (3D) inductor 22, which in this embodiment is a solenoid inductor. Each of the conductive layers 18 is shaped to form a winding 24, and the conductive vias 20 connect the ends of the windings 24 on different conductive layers 18. Note however that the footprint of the ends of the windings 24 are larger than the footprint of the attachment surface of the conductive vias 20, and thus an outer contour of the ends extends horizontally past the attachment surface of the conductive vias 20. This was done to prevent via misalignments and undesired shorts when the 3D inductor 22 was being formed. However, one of the problems with this arrangement is that current will be misdirected to flow horizontally through the outer contour of the ends that extends horizontally past the attachment surface of the conductive vias 20. This unfortunately results in stray magnetic behavior and causes the current to have to travel farther. As such, this results in a degradation of the quality (Q) factor of the 3D inductor 22. Another problem with the arrangement shown in FIG. 1 is that there is a large difference between the thickness of the conductive layers 18 and the depth of the conductive vias 20. This also degrades the Q factor of the 3D inductor 22 and places hard limitations on the routing density of the conductive structure 14.

FIG. 2 illustrates one embodiment of a 3D inductor 26 created in a PCB 28. The PCB 28 has a substrate body 30 and a conductive structure 32 that is integrated into the substrate body 30. The 3D inductor 26 is formed as part of the conductive structure 32 on and within the substrate body 30. The 3D inductor 26 shown in FIG. 2 is described in further detail in U.S. Pat. No. 9,196,406 entitled "HIGH Q FACTOR INDUCTOR STRUCTURE" issued on Nov. 24, 2015, which is hereby incorporated by reference in its entirety.

The 3D inductor 26 provides a conductive path 34 that extends in all three dimensions but curves back in on itself. The conductive path 34 therefore surrounds a perimeter of a 3D area and encloses a 3D volume 36. To form the conductive path 34, the 3D inductor 26 comprises four elongated via columns (referred to generically as element 38, and specifically as elongated via columns 38*a*, 38*b*, 38*c*, and 38*d*). Each of the elongated via columns 38 is formed by a stack of elongated vias 40 (not all labeled for the sake of clarity). Also, to form the conductive path 34, the 3D inductor 26 of FIG. 2 also comprises three connector plates 42, 44*a*, and 44*b*. The connector plate 42 connects the elongated via column 38*b* to the elongated via column 38*c* on a first vertical side SA of the 3D inductor 26. On a second vertical side SB of the 3D inductor 26 that is antipodal to the first vertical side SA, the connector plate 44*a* connects the elongated via column 38*a* to the elongated via column 38*b*, and the connector plate 44*b* connects the elongated via column 38*c* to the elongated via column 38*d*. The 3D inductor 26 of FIG. 2 further comprises two terminal plates 46 and 48 to form part of the conductive path 34. The terminal plates 46 and 48 comprise a terminal connection for the 3D inductor 26 and are connected to the elongated via columns 38*a*, 38*d*, respectively, at the first vertical side SA.

Current flows across the terminal plate 46 down the elongated via column 38*a* to the connector plate 44*a*. The current flow continues across the connector plate 44*a* up through the elongated via column 38*b* to the connector plate 42. The current flow then continues across the connector plate 42 down through the elongated via column 38*c* to the connector plate 44*b*. The current flow continues up through the elongated via column 38*d* to the terminal plate 48.

From the above current flow description, it can be seen that the 3D inductor 26 provides a significant amount of magnetic field cancellation since the majority of sections along the conductive path 34 can be matched to a symmetrical section where current flows in the opposite direction. This allows the 3D inductor 26 to be utilized to provide weak magnetic coupling between resonators and thereby to provide filtering circuit with a high quality (Q) factor.

As shown in FIG. 2, each of the elongated vias 40 in columns 38 includes a conductive post 50 (not all labelled for the sake of clarity). Additionally, except for the elongated vias 40 connected to the connector plate 42 and the terminal plates 46, 48, each of the elongated vias 40 has a capture pad 52 (not all labelled for the sake of clarity). Each of the conductive posts 50 extends vertically through a one of the substrate layers 54 of the substrate body 30. The capture pads 52 are formed by conductive layers 56 (not all labeled for the sake of clarity) within the substrate body 30. The capture pads 52 allow for the conductive posts 50 of the next elongated via 40 in the columns 38 to be formed while avoiding undesired connections resulting from misalignments. However, the capture pads 52 have a much larger footprint than the conductive posts 50. Since the high frequency RF current travels along the metal surface, the current will travel horizontally along the surface of the capture pads 52 as the current propagates through the column 38. Accordingly, the current has to travel a greater distance as the current propagates through the columns 38. Furthermore, the capture pads 52 result in significant Q factor degradation due to magnetic field distortions resulting from the current propagating horizontally through the capture pads 52.

Accordingly, better techniques are needed in order to connect conductive structures within a 3D inductor using vias while still preventing undesired connections from via misalignment.

SUMMARY

This disclosure relates generally to substrate having three dimensional (3D) inductors and methods of manufacturing the same. The substrate has a substrate body and a 3D inductor integrated into the substrate body. In one embodiment, the 3D inductor includes a first connector plate, a second connector plate, and a first (vertical interconnect access structure) via column attached between the first connector plate and the second connector plate. The first via column includes a first vertical interconnect access structure (via) having a first via attachment surface that defines a first via surface contour and a second via having a second via attachment surface on the first via attachment surface. The second via attachment surface defines a second via surface contour approximately the same as and approximately aligned with the first via surface contour. In this manner, no carrier pads are needed and there is not overhang between the conductive vias.

In a second embodiment, the 3D inductor has a first vertical via having a first via attachment surface that defines a first via surface contour and a first winding. The first winding has a first winding end having a first winding end surface section provided by the first via attachment surface. The first winding end surface section is attached to the first via attachment surface such that an exterior edge contour of the first winding end surface section is substantially aligned with and is substantially the same as exterior edge contour of the first via surface contour. In this manner, there is not overhand between the first winding and the first vertical via.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
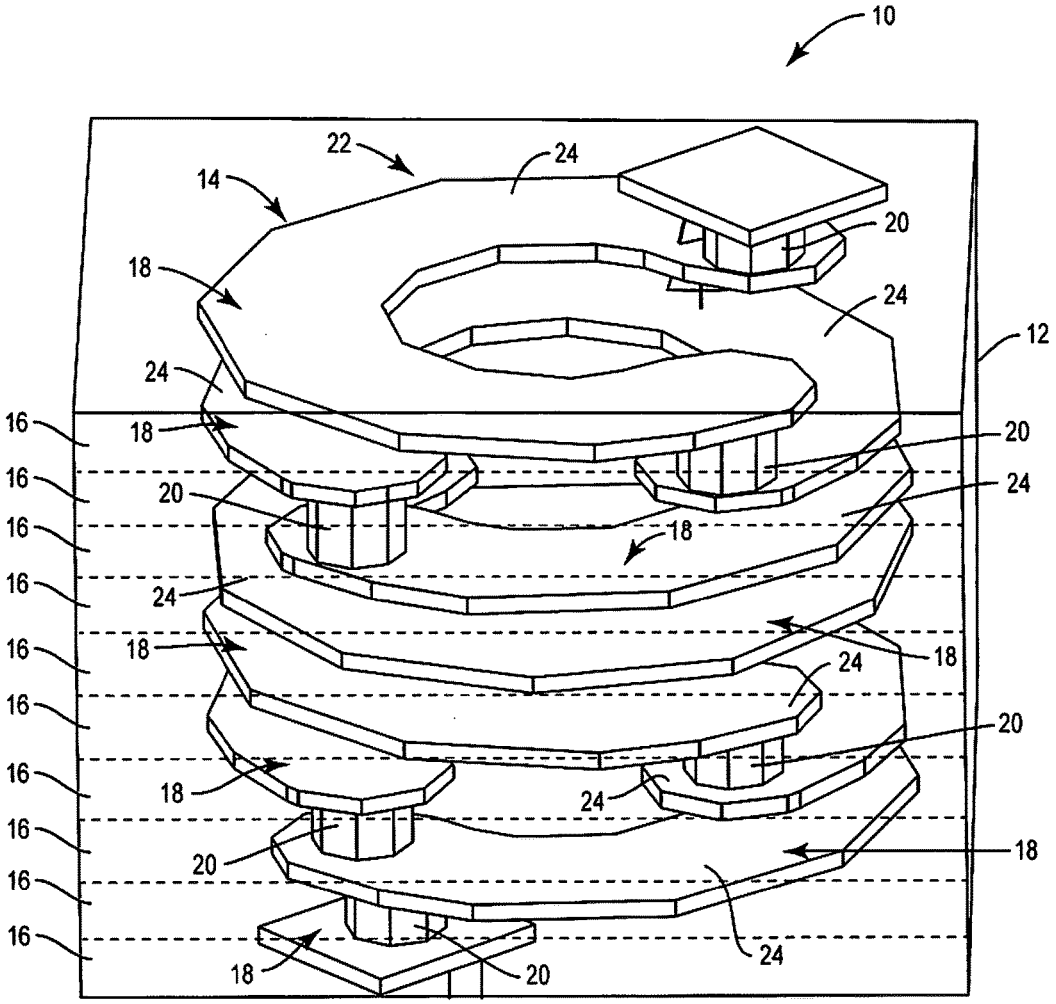
FIG. 1 (RELATED ART)
FIG. 1 illustrates a substrate with a solenoid three dimensional (3D) inductor of related art where there is overhand between the windings and the conductive vias.
Figure 2:
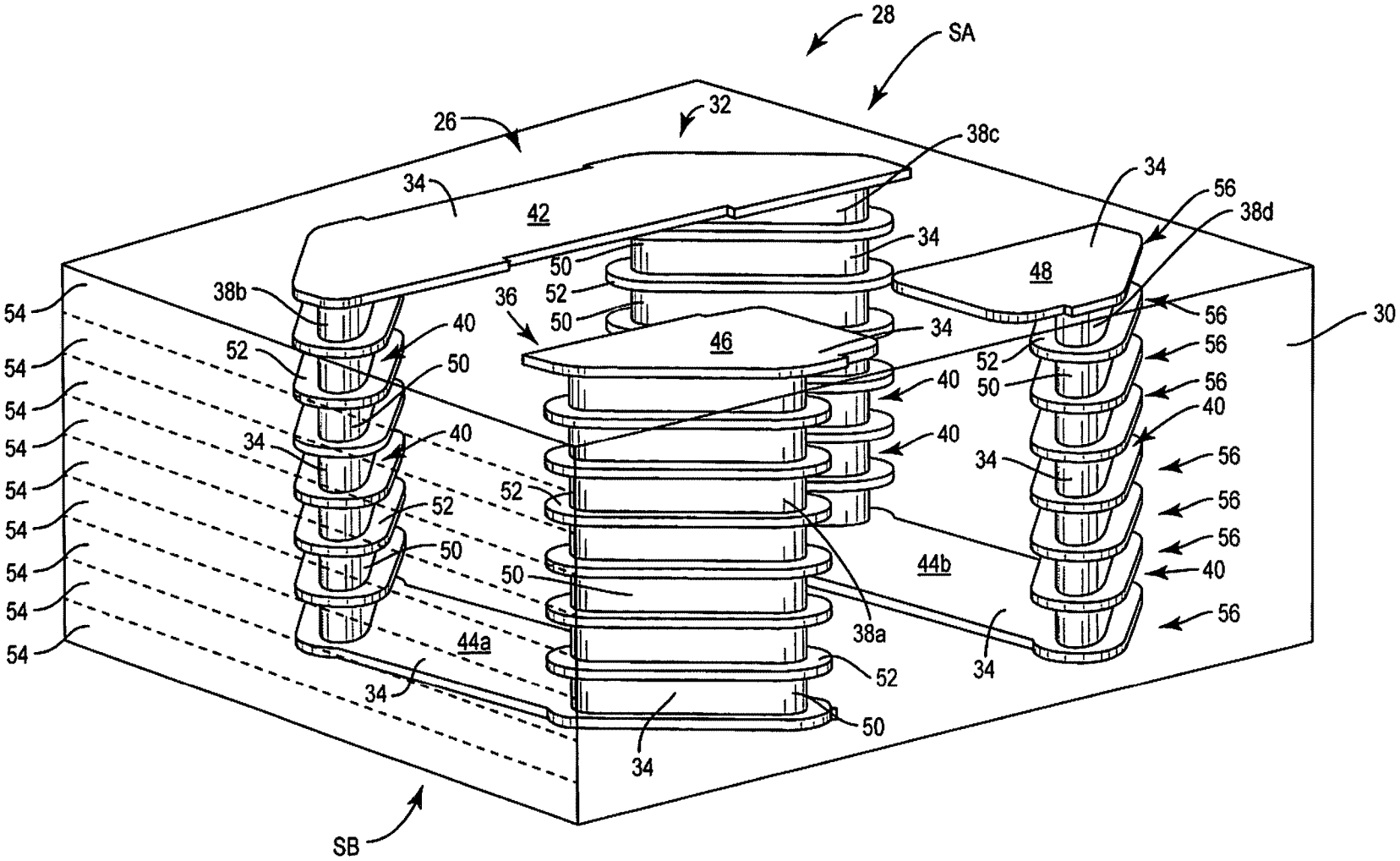
FIG. 2 (RELATED ART)
FIG. 2 illustrates another embodiment of a substrate having a 3D inductor where conductive vias have carrier pads that result in overhang.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Throughout this disclosure, relative terminology, such as "approximately," "substantially," and the like, may be used with a predicate to describe features and relationships between features of a device or method. The relative terminology used with the predicate should be interpreted sensu lato. However, whether the predicate as modified by the relative terminology is satisfied is determined in accordance to error ranges and/or variation tolerances relevant to the predicate and/or prescribed to the device or method by radio frequency (RF) front end circuitry communication standards relevant to the RF application(s) employing the device or method. For example, the particular RF application employing the device or method may be designed to operate in accordance with certain communication standards, specifications, or the like. These communication standards and specification may prescribe the error ranges and/or variation tolerances relevant to the predicate or may describe performance parameters relevant to the predicate from which the error ranges and/or variation tolerances for determining the criteria for the predicate as modified by the terminology can be deduced or inferred.

This disclosure relates generally to substrate having three dimensional (3D) inductors and methods of manufacturing the same. The substrate has a substrate body and a 3D inductor integrated into the substrate body. In one embodiment, the 3D inductor includes a first connector plate, a second connector plate, and a first (vertical interconnect access structure) via column attached between the first connector plate and the second connector plate. The first via column includes a first vertical interconnect access structure (via) having a first via attachment surface that defines a first via surface contour and a second via having a second via attachment surface on the first via attachment surface. The second via attachment surface defines a second via surface contour approximately the same as and approximately aligned with the first via surface contour. In this manner, no carrier pads are needed and there is not overhang between the conductive vias.

In a second embodiment, the 3D inductor has a first vertical via having a first via attachment surface that defines a first via surface contour and a first winding. The first winding has a first winding end having a first winding end surface section provided by the first via attachment surface. The first winding end surface section is attached to the first via attachment surface such that an exterior edge contour of the first winding end surface section is substantially aligned with and is substantially the same as exterior edge contour of the first via surface contour. In this manner there is not overhand between the first winding and the first vertical via.

Figure 3:
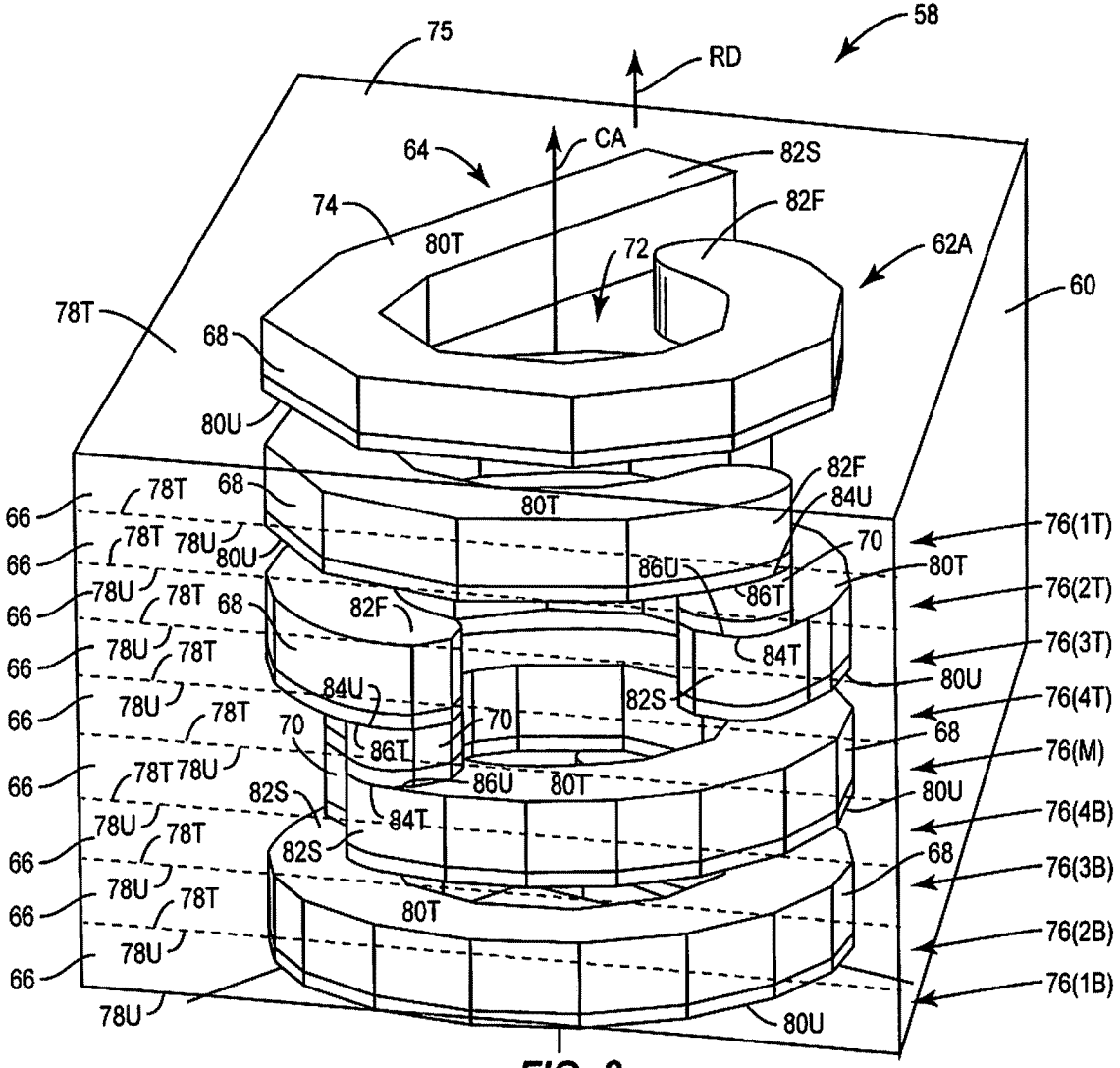
FIG. 3 illustrates one embodiment of a solenoid 3D inductor where there is no overhang between the windings and the conductive vias.

FIG. 3 illustrates one embodiment of a substrate 58 that includes a 3D inductor 62A. More specifically, the substrate 58 has a substrate body 60 and a conductive structure 64 that is integrated into the substrate body 60. The 3D inductor 62A is formed as part of the conductive structure 64 on and within the substrate body 60. The substrate body 60 is made from suitable non-conductive material(s) and/or semiconductor material(s). Exemplary non-conductive materials include laminates, semiconductor materials, glass, dielectrics, plastics, fibers, ceramics and/or the like. Exemplary semiconductor materials include Silicon (Si), Silicon Germanium (SiGe), Gallium Arsenide (GaAs), Indium Phosphorus (InP), and/or the like.

In this embodiment, the substrate 58 is a multi-layered substrate and thus the substrate body 60 includes a plurality of substrate layers 66 that are stacked. Thus, the substrate layers 66 are each on different vertical levels (referred to generically as vertical levels 76 and specifically as vertical level 76(1T), vertical level 76(2T) vertical level 76(3T) vertical level 76(4T), vertical level 76(M), vertical level 76(4B), vertical level 76(3B), vertical level 76(2B), vertical level 76(1B)). Taking a reference vertical direction RD as a normal at a substrate surface 75 that points away from the substrate body 60, the vertical level 76(1T) is highest vertical level. The vertical level 76(1T) is thus adjacent to but higher than the vertical level 76(2T). The vertical level 76(2T) is adjacent to but higher than the vertical level 76(3T). The vertical level 76(3T) is adjacent to but higher than the vertical level 76(4T). The vertical level 76(4T) is adjacent to but higher than the vertical level 76(M). The vertical level 76(M) is adjacent to but higher than the vertical level 76(4B). The vertical level 76(4B) is thus adjacent to but higher than the vertical level 76(3B). The vertical level 76(3B) is thus adjacent to but higher than the vertical level 76(2B). The vertical level 76(2B) is thus adjacent to but higher than the vertical level 76(1B). The vertical level 76(1B) is the lowest vertical level. One implementation of the substrate 58 is a printed circuit board (PCB). The substrate layers 66 may be each be formed from a laminate such as FR-1, FR-2, FR-3, FR-4, FR-5, FR-6, CEM-1, CEM-2, CEM-3, CEM-4, CEM-5, CX-5, CX-10, CX-20, CX-30, CX-40, CX-50, CX-60, CX-70, CX-80, CX-90, CX-100, and/or the like.

The conductive structure 64 may be formed on and/or within the substrate body 60 using any type of suitable conductive material(s). These conductive materials may be made from any type of metal(s) including, for example, copper (Cu), gold (Au), silver (Ag), Nickel (Ni), metallic alloys, and/or the like. Conductive materials may also be non-metallic conductive materials (e.g., graphene). The 3D inductor 62A shown in FIG. 3 is formed as part of the conductive structure 64. In this embodiment, the 3D inductor is a solenoid inductor. Thus, the 3D inductor 62A shown in FIG. 3 is formed by windings 68 and conductive vias 70 (not all labeled for the sake of clarity) that connect the windings 68. In this manner, the 3D inductor 62A provides a conductive path 74. The conductive path 74 extends in all three dimensions but extends continuously in the z-direction and thus does not curve back into itself vertically. The windings 68 of 3D inductor 62A are all wound and substantially aligned around a common axis CA. Accordingly, the 3D inductor 62A encloses a 3D volume 72 that defines an interior of the 3D inductor 62A.

Adjacent pairs of the windings 68 are each connected by the conductive vias 70 so that current can propagate though the conductive path 74 in the same rotational current direction. In this embodiment, the windings 68 are circular but may be of any suitable shape in alternative embodiments. The windings 68 provide the perimeter of the 3D volume 72 enclosed by the 3D inductor 62A. In this embodiment, each of the windings 68 provided by the conductive structure 64 is formed within a corresponding one of the substrate layers 66 at a different one of the vertical levels 76(1T), vertical level 76(3T), vertical level 76(M), vertical level 76(3B), vertical level 76(1B). Each of the conductive vias 70 is formed within a corresponding one of the substrate layers 66 at a different one of the vertical levels 76(2T), vertical level 76(4T), vertical level 76(4B), vertical level 76(2B). Thus, the substrate layers 66 that include the conductive vias 70 are stacked directly between a corresponding pair of the substrate layers 66 that include the windings 68.

Note each of the substrate layers 66 has a top substrate layer surface 78T and a bottom substrate layer surface 78U, which is displaced vertically so as to define a thickness of the substrate layer 66. Thus, for each of the substrate layers 66, the top substrate layer surface 78T is oppositely disposed from the bottom substrate layer surface 78U. The windings 68 each have a winding surface 80T and a winding surface 80U, which is displaced vertically so as to define a thickness of the winding 68. Thus, for each of the windings 68, the winding surface 80T is oppositely disposed to the winding surface 80U. In this embodiment, the thickness of each of the windings 68 is approximately comparable to each of the thicknesses of the substrate layer 66 in which the winding 68 is formed. Thus, the winding surface 80T of each of the windings 68 is exposed from the top substrate layer surface 78T of the substrate layer 66 in which the winding is formed. Also, the winding surface 80U of each of the windings 68 is exposed from the bottom substrate layer surface 78U of the substrate layer 66 in which the winding 68 is formed. Note that the top substrate layer surface 78T of the substrate layer 66 at the vertical level 76(1T) is the substrate surface 75.

As shown in FIG. 3, each of the windings 68 extend horizontally so as to define a winding end 82S (not all labeled for the sake of clarity) at the beginning of the winding 68 and a winding end 82F (not all labeled for the sake of clarity) at the finality of the winding 68. In each of the windings 68, the winding end 82S and the winding end 82F are oppositely disposed. Furthermore, for each of the windings 68, the winding end 82F has a winding end surface section 84U (not all labeled for the sake of clarity), which is part of and thus provided by the winding surface 80U. Thus, the winding end surface section 84U of each of the windings 68 is exposed from the bottom substrate layer surface 78U of the substrate layer 66 that forms the winding 68. Additionally, for each of the windings 68, the winding end 82S has a winding end surface section 84T (not all labeled for the sake of clarity), which is part of and is thus provided by the winding surface 80T. Thus, the winding end surface section 84T of each of the windings 68 is exposed from the top substrate layer surface 78T of the substrate layer 66 that forms the winding 68.

For each of the conductive vias 70, the conductive vias 70 extends vertically through the substrate layer 66 within which the conductive via 70 is formed. Each of the conductive vias 70 includes a via attachment surface 86T (not all labeled for the sake of clarity) and a via attachment surface 86U (not all labeled for the sake of clarity). For each of the conductive vias 70, the via attachment surface 86T is exposed from the top substrate layer surface 78T of the substrate layer 66 within which the conductive via 70 is formed. In this manner, the via attachment surface 86T of each of the conductive vias 70 is attached to the winding end surface section 84U of the winding 68 formed in the substrate layer 66 adjacent to and directly above the substrate layer 66 in which the conductive via 70 is formed. Also, for each of the conductive vias 70, the via attachment surface 86U is exposed from the bottom substrate layer surface 78U of the substrate layer 66 within which the conductive via 70 is formed. In this manner, the via attachment surface 86U of each of the conductive vias 70 is attached to the winding end surface section 84T of the winding 68 formed in the substrate layer 66 adjacent to and directly below the substrate layer 66 in which the conductive via 70 is formed.

A depth of each of the conductive vias 70 is thus defined as a distance between the via attachment surface 86T and a via attachment surface 86U, and the via attachment surface 86T and the via attachment surface 86U are oppositely disposed. Accordingly, the depth of each of the conductive vias 70 is approximately equal to each the thickness of the substrate layer 66 in which the conductive via 70 is formed. In this embodiment, each of the conductive vias 70 is formed to only be a conductive post and to not include capture pads. As such, for each of the conductive vias 70, the via attachment surface 86T is provided as a horizontal end surface of the conductive post that is exposed from the top substrate layer surface 78T of the substrate layer 66 in which the conductive via 70 is formed. Furthermore, for each of the conductive vias 70, the via attachment surface 86U is provided as a horizontal end surface of the conductive post that is exposed from the bottom substrate layer surface 78U of the substrate layer 66 in which the conductive via 70 is formed. As such, a vertical length of the conductive post forming each of the conductive vias 70 provides the entire depth of the conductive vias 70 since the conductive vias 70 do not include capture pads.

Note that there is little to no overhang for the conductive vias 70 and the winding ends 82S, 82F of the windings 68. For each of the conductive vias 70 that are attached to the winding end surface section 84U, the winding end surface section 84U of each of the windings 68 and the via attachment surface 86T has its exterior edges (outer most boundary edges that border defining a boundary between an exterior and interior of the 3D inductor 62A) substantially aligned to have substantially the same shape. Similarly, the winding end surface section 84T of each of the windings 68 and the via attachment surface 86U of each of the conductive vias 70 that are attached to the winding end surface section 84T must be substantially aligned and have substantially the same shape. Otherwise, a significant amount of overhang would be the result, and there would be horizontal current flow toward the exterior of the windings 68 as current traveled from the windings ends 82S, 82F to the conductive vias 70.

More specifically, in the embodiment shown in FIG. 3, the winding end surface section 84T of the winding end 82S of each of the windings 68 defines an exterior edge contour, and each of the winding end surface section 84U of each of the winding ends 82F, 82S of each of the windings 68 defines an exterior edge contour. Additionally, the via attachment surface 86T of each of the conductive vias 70 defines a via surface contour, and the via attachment surface 86U of each of the conductive vias 70 defines a via surface contour. At the outermost exterior edge, the via surface contour of the via attachment surface 86T of each of the conductive vias 70 defines an exterior edge contour, and the via surface contour of the via attachment surface 86U of each of the conductive vias 70 defines an exterior edge contour. As shown in FIG. 3, for the winding end surface section 84U of each of the windings 68 and the via attachment surface 86T of each of the conductive vias 70 that are attached to the winding end surface section 84U, the exterior edge contour of the winding end surface section 84U is substantially aligned with and is substantially the same as exterior edge contour of the via surface contour of the via attachment surface 86T. Additionally, for the winding end surface section 84T of each of the windings 68 and the via attachment surface 86U of each of the conductive vias 70 that are attached to the winding end surface section 84T, the exterior edge contour of the winding end surface section 84T is substantially aligned with and is substantially the same as exterior edge contour of the via surface contour of the via attachment surface 86U. Thus, there is little to no overhang and substantially no horizontal current flow as the current propagates between the winding ends 82S, 82F of each of the windings 68 and the conductive vias 70. This increases a quality (Q) factor of the 3D inductor 62A.

Note that the thickness of each of the windings 68 is the same as the depth of each of the conductive vias 70. In this embodiment, the thickness of each of the windings is approximately 50 micrometers, and the depth of each of the conductive vias is approximately 50 micrometers.

Figure 4A:
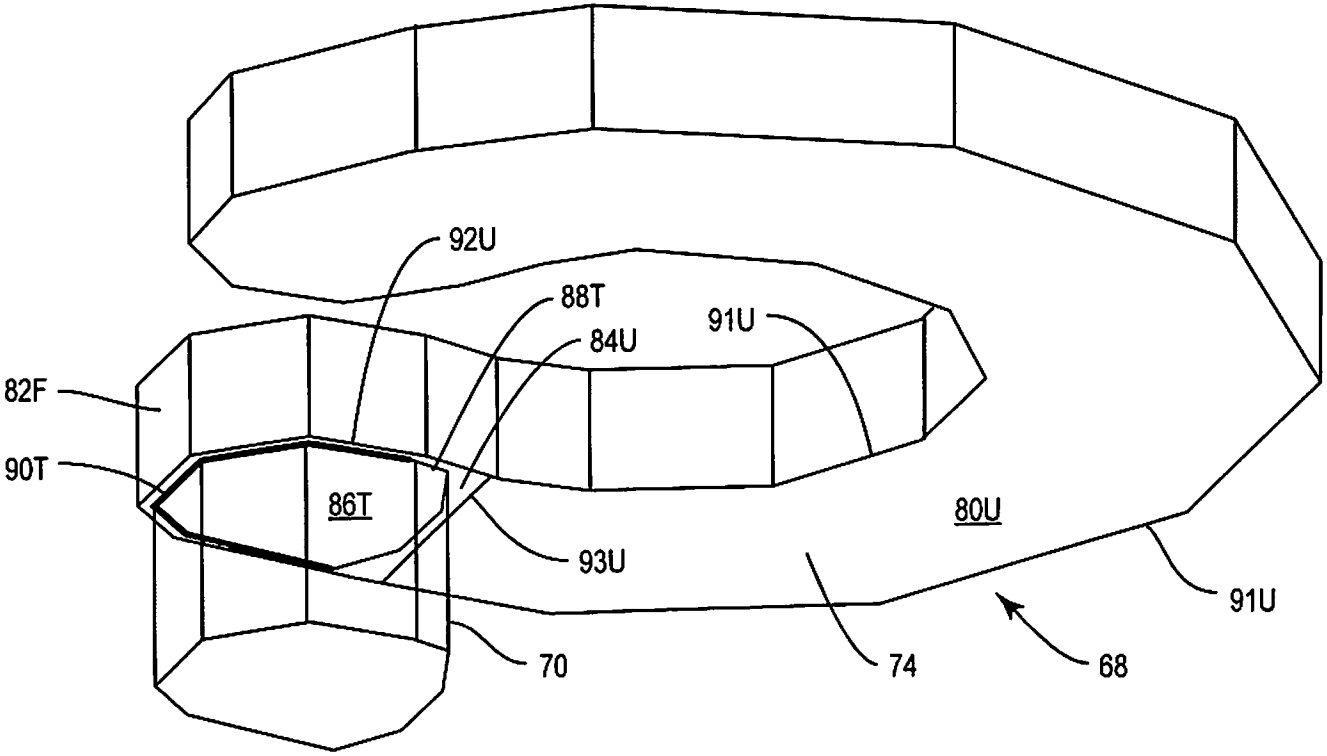
FIGS. 4A-4B illustrate the surface contours of the windings and conductive vias shown in FIG. 3.

FIG. 4A is a bottom view of the winding surface 80U of one of the windings 68 and the via attachment surface 86T of one of the conductive vias 70 shown in FIG. 3. Each of the windings 68 having the winding end surface section 84U and each of the conductive vias 70 having the via attachment surface 86T attached to the winding end surface section 84U in FIG. 3 are arranged as shown in FIG. 4A. As shown in FIG. 4A, the conductive via 70 is provided simply as the conductive post, and thus the via attachment surface 86T is simply a horizontal surface at a top end of the conductive post. In this embodiment, the conductive post is cylindrical, and thus the via attachment surface 86T is a circular surface. A surface contour 88T is the edge that defines the boundary of the via attachment surface 86T. Thus, in this embodiment, the surface contour 88T is simply the circular edge that bounds of the via attachment surface 86T. An exterior edge contour 90T is simply the portion of the surface contour 88T that provides an exterior edge of the conductive path 74 at the via attachment surface 86T.

The winding end 82F of the winding 68 is attached to the conductive via 70. FIG. 4A shows the winding surface 80U which is the bottom surface of the winding 68. The winding end 82F has the winding end surface section 84U provided by the winding surface 80U. The winding end surface section 84U is attached to the via attachment surface 86T. More specifically, the winding end 82F has the winding end surface section 84U which is the bottom surface of the winding end 82F and is provided by the winding surface 80U of the winding 68. The winding surface 80U defines a winding surface contour 91U at the boundary of the winding surface 80U. The shape of the winding surface 80U thus determines the winding surface contour 91U. An exterior edge contour 92U of the winding end surface section 84U of the winding end 82F provides an exterior edge of the conductive path 74 at the winding end surface section 84U. Since the winding surface 80U includes the winding end surface section 84U, the winding surface 80U also defines a winding end surface section contour 93U of the winding end surface section 84U at the winding end 82F. The exterior edge contour 92U is defined by the exterior edge of the winding end surface section contour 93U of the winding end surface section 84U. As shown in FIG. 4A, the exterior edge contour 92U of the winding end surface section 84U is substantially aligned with the exterior edge contour 90T of the surface contour 88T of the via attachment surface 86T. As such, as the current propagates from the via attachment surface 86T to the winding end surface section 84U of the winding end 82F, the current does not horizontally propagate substantially past the exterior edge contour 90T of the via attachment surface 86T. This decreases the length of the conductive path 74 and also decreases magnetic field distortion thereby increasing the Q factor of the 3D inductor 62A.

Figure 4B:
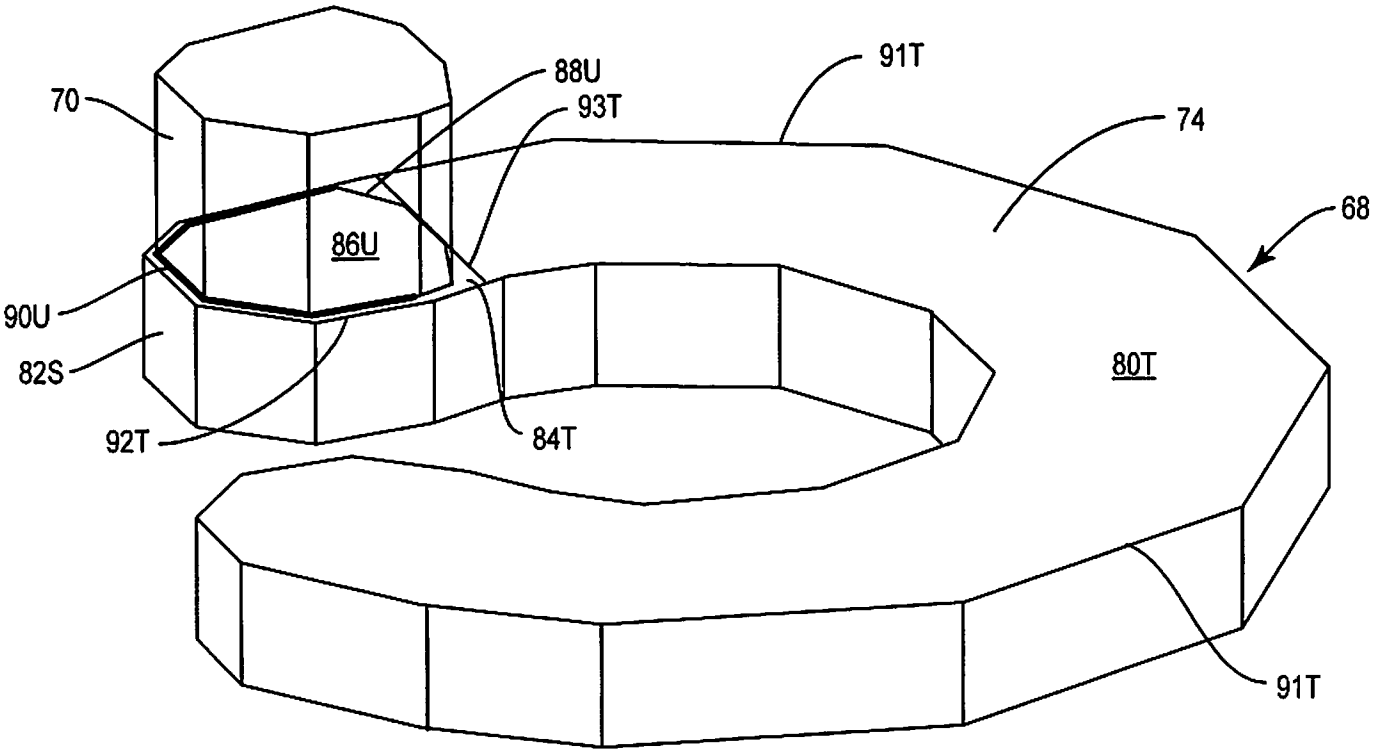

FIG. 4B is a top view of the winding surface 80T of one of the windings 68 and the via attachment surface 86U of one of the conductive vias 70 shown in FIG. 3. Each of the windings 68 having the winding end surface section 84T and each of the conductive vias 70 having the via attachment surface 86U attached to the winding end surface section 84T in FIG. 3 are arranged as shown in FIG. 4B. As shown in FIG. 4B, the conductive via 70 is provided simply as the conductive post, and thus the via attachment surface 86U is simply a horizontal surface at a bottom end of the conductive post. In this embodiment, the conductive posts are cylindrical and thus the via attachment surface 86U is a circular surface. The surface contour 88U is the edge that defines the boundary of the via attachment surface 86U. Thus, in this embodiment, the surface contour 88U is simply the circular edge that bounds the via attachment surface 86U. An exterior edge contour 90U is simply the portion of the surface contour 88U along an exterior edge of the conductive path 74 at the via attachment surface 86U.

The winding end 82S of the winding 68 is attached to the conductive via 70. FIG. 4B shows the winding surface 80T, which is the top surface of the winding 68. The winding end 82S has the winding end surface section 84T provided by the winding surface 80T. The winding end surface section 84T is attached to the via attachment surface 86U. More specifically, the winding end 82S has the winding end surface section 84T, which is the bottom surface of the winding end 82S and is provided by the winding surface 80T of the winding 68. The winding surface 80T defines a winding surface contour 91T at the boundary of the winding surface 80T. The shape of the winding surface 80T thus determines the winding surface contour 91T. An exterior edge contour 92T of the winding end surface section 84T of the winding end 82S provides an exterior edge of the conductive path 74 at the winding end surface section 84T. Since the winding surface 80U includes the winding end surface section 84T, the winding surface 80T also defines the winding end surface section contour 93T of the winding end surface section 84T at the winding end 82S. The exterior edge contour 92T is defined by the exterior edge of the winding end surface section contour 93T of the winding end surface section 84T. As shown in FIG. 4B, the exterior edge contour 92T of the winding end surface section 84T is substantially aligned with the exterior edge contour 90U of the surface contour 88U of the via attachment surface 86U. As such, as the current propagates from the via attachment surface 86U to the winding end surface section 84T of the winding end 82S, and the current does not horizontally propagate substantially past the exterior edge contour 90U of the via attachment surface 86U. This decreases the length of the conductive path 74 and also decreases magnetic field distortion, thereby increasing the Q factor of the 3D inductor 62A.

Figure 5:
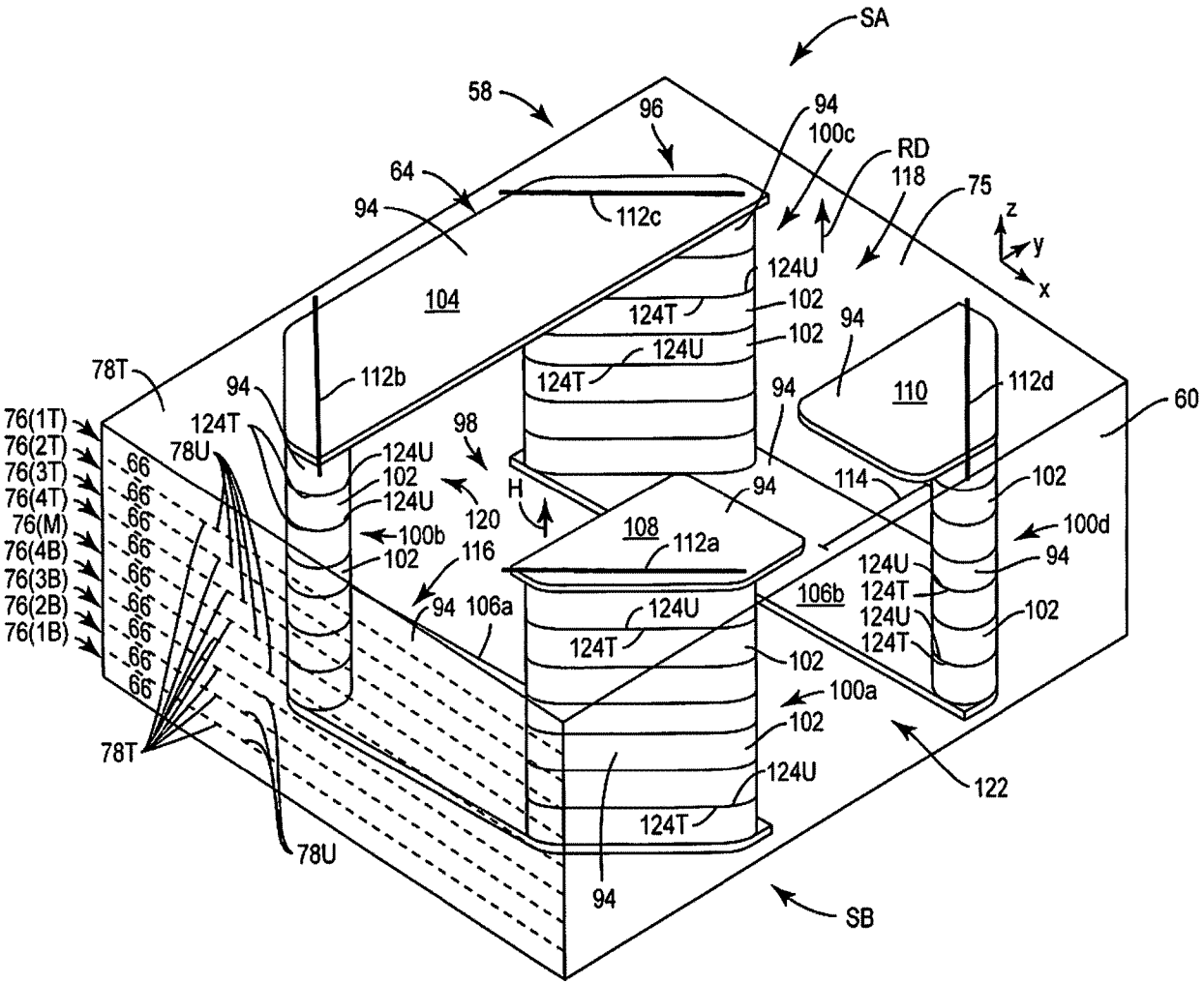
FIG. 5 illustrates another embodiment of a substrate having a 3D inductor where there is no overhang between the conductive vias in the via columns.

FIG. 5 illustrates another implementation of the substrate 58 that includes another embodiment of a 3D inductor 62B created in a substrate 58. The substrate 58 has the substrate body 60 and the conductive structure 64 that is integrated into the substrate body 60. The 3D inductor 62B is formed as part of the conductive structure 64 on and within the substrate body 60. The substrate body 60 is made from suitable non-conductive material(s) and/or semiconductor material(s). Exemplary non-conductive materials include laminate, a semiconductor material, glass, a dielectric, plastic, fiber, and/or the like. Exemplary semiconductor materials include Silicon (Si), Silicon Germanium (SiGe), Gallium Arsenide (GaAs), Indium Phosphorus (InP), and/or the like.

The substrate 58 may also be single layered or multi-layered. In this embodiment, the substrate 58 is a multi-layered substrate, and the substrate body 60 is made from a laminate. The multi-layered substrate 58 thus includes the substrate body 60, which is formed from the plurality of substrate layers 66 that are vertically stacked to form the substrate body 60. The substrate layers 66 are each on the different vertical levels 76. Taking the reference vertical direction RD as a normal at the substrate surface 75 that points away from the substrate body 60, the vertical level 76(1T) is highest vertical level. The vertical level 76(1T) is thus adjacent to but higher than the vertical level 76(2T). The vertical level 76(2T) is adjacent to but higher than the vertical level 76(3T). The vertical level 76(3T) is adjacent to but higher than the vertical level 76(4T). The vertical level 76(4T) is adjacent to but higher than the vertical level 76(M). The vertical level 76(M) is adjacent to but higher than the vertical level 76(4B). The vertical level 76(4B) is thus adjacent to but higher than the vertical level 76(3B). The vertical level 76(3B) is thus adjacent to but higher than the vertical level 76(2B). The vertical level 76(2B) is thus adjacent to but higher than the vertical level 76(1B). The vertical level 76(1B) is the lowest vertical level. In one embodiment, the substrate 58 is a PCB. The substrate layers 66 may be each be formed from a laminate such as FR-1, FR-2, FR-3, FR-4, FR-5, FR-6, CEM-1, CEM-2, CEM-3, CEM-4, CEM-5, CX-5, CX-56B, CX-20, CX-30, CX-40, CX-50, CX-60, CX-70, CX-80, CX-90, CX-56B0, and/or the like.

The conductive structure 64 may be formed on and/or within the substrate body 60 using any type of suitable conductive material(s). These conductive materials may be made from any type of metal(s) including, for example, copper (Cu), gold (Au), silver (Ag), Nickel (Ni), metallic alloys, and/or the like. Conductive materials may also be non-metallic conductive materials (e.g., graphene).

While the specific embodiments described in this disclosure are implemented using a multi-layered substrate, the 3D inductor 62B described herein is not limited to multi-layered substrates. Alternatively, the 3D inductor 62B may be implemented using single-layered substrates.

With regard to the 3D inductor 62B shown in FIG. 5, the 3D inductor 62B provides a conductive path 94. The conductive path 94 extends in all three dimensions but curves back in on itself. More specifically, the conductive path 94 has a shape corresponding to a two-dimensional (2D) lobe 96 laid over a three-dimensional (3D) volume 98. In this embodiment, the 2D lobe 96 is approximately shaped as a square (which is a special case of a polygon), and the 3D volume 98 is approximately shaped as a cube (which is a special case of a polynoid). However, as explained in U.S. Pat. No. 9,899,133, which is hereby incorporated herein by reference in its entirety, the 2D lobe 96 and 3D volume 98 may each be of any 2D shape and 3D 30 shape, respectively.

Note that the 2D lobe 96 is not a 2D structure but is rather a 3D structure, since the 2D lobe 96 is laid over the 3D volume 98. In other words, the 2D lobe 96 would be a 2D structure if the 2D lobe 96 were laid over a 2D plane. However, the 2D lobe 96 is a 3D structure because the 3D volume 98 provides a 3D manifold, and the 2D lobe 96 is folded onto the 3D volume 98. The 2D lobe 96 may be any conductive structure that is at least partially bounded so as to form a loop, since the 2D lobe 96 curves back in on itself. In other words, the face of the 2D lobe 96 has been bent so that at the 2D lobe 96 surrounds a perimeter of a 3D area at the boundary of the 3D volume 98.

To form the conductive path 94, the 3D inductor 62B comprises four elongated via columns (referred to generically as element 100, and specifically as elongated via columns 100*a*, 100*b*, 100*c*, and 100*d*). Each of the elongated via columns 100 is formed by a stack of conductive vias 102 (not all labeled for the sake of clarity). In this embodiment, each of the conductive vias 102 is formed as a conductive post and none of the conductive vias 102 have carrier pads. Thus within each of the columns 100, each of the conductive vias 102 is formed only by a conductive post and there are no carrier pads between the conductive posts. Furthermore, the conductive posts (which are the conductive vias 102) are elongated as explained in further detail below. Four of the conductive vias 102 (one from each of the columns 100*a*, 100*b*, 100*c*, 100*d*) are provided within each of the substrate layers 66 at the vertical levels 76(2T), 76(3T), 76(4T), 76(M), 76(4B), 76(3B). A connector plate 104 and terminal plates 108, 110 are formed within the substrate layer 66 at the vertical level 76(1T). The connector plates 106*a*, 106*b* are each formed within the substrate layer 66 at the vertical level 76(1B).

As shown in FIG. 5, to form the conductive path 94, the 3D inductor 62B of FIG. 5 also comprises three connector plates 104, 106*a*, and 106*b*. The connector plate 104 connects the elongated via column 100*b* to the elongated via column 100*c* on a first vertical side SA of the 3D inductor 62B. On a second vertical side SB of the 3D inductor 62B that is antipodal to the first vertical side SA, the connector plate 106*a* connects the elongated via column 100*a* to the elongated via column 100*b*, and the connector plate 106*b* connects the elongated via column 100*c* to the elongated via column 100*d*. The 3D inductor 62B of FIG. 5 further comprises two terminal plates 108 and 110 to form part of the conductive path 94. The terminal plates 108 and 110 comprise a terminal connection for the 3D inductor 62B and are connected to the elongated via columns 100*a*, 100*d*, respectively, at the first vertical side SA.

Current flows from the terminal plate 108 down the elongated via column 100*a* to the connector plate 106*a*. The current flow continues across the connector plate 106*a* up through the elongated via column 100*b* to the connector plate 104. The current flow then continues across the connector plate 104 down through the elongated via column 100*c* to the connector plate 106*b*. The current flow continues up through the elongated via column 100*d* to the terminal plate 110.

Note that the conductive vias 102 are elongated, and thus each of the elongated via columns 100 are elongated relative to a plane. Accordingly, the elongated via column 100*a* is elongated with respect to a plane 112*a*, the elongated via column 100*b* is elongated with respect to a plane 112*b*, the elongated via column 100*c* is elongated with respect to a plane 112*c*, and the elongated via column 100*d* is elongated with respect to a plane 112*d*. Thus, a cross sectional horizontal area of each of the elongated via columns 100 has a major axis longer than a minor axis. Note also that each of the connector plates 104, 106*a*, 106*b* are each shaped as a trapezoid where the exterior parallel edge of each the connector plates 104, 106*a*, 106*b* provides the short base of the trapezoid, while the interior parallel edge of each of the connector plates 104, 106*a*, 106*b* provides the long base of the trapezoid. The opposite disposed end edges of each the connector plates 104, 106*a*, 106*b* provide the legs of the trapezoid. In this case, each of the connector plates 104, 106*a*, 106*b* is shaped as an isosceles trapezoid where an angle between each of the legs to the long base is approximately 45 degrees while an angle between each of the legs and the short base is approximately 135 degrees. Each of the elongated via columns is angled so that their respective planes 112 are substantially parallel with the end edges of the connector plates 104, 106*a*, 106*b* of the respective elongated via column 100 with which the elongated via column connects. Thus, each elongated via column 100 connects to the connector plates 104, 106*a*, 106*b* such that an angle between the respective plane 112 of the elongated via column 100 and the interior edge of the connector plate 104, 106*a*, 106*b* it connects to is approximately 45 degrees, while an angle between the respective plane 112 of the elongated via column 100 and the exterior edge of the connector plate 104, 106*a*, 106*b* it connects to is approximately 135 degrees. Similarly, the terminal plates 108, 110 are each shaped as trapezoids, but in this case, right trapezoids. However, the combination of the terminal plates 108, 110 would form the same trapezoid as the connector plates 104, 106*a*, 106*b* except that there is a gap between each of the right angled edges terminal plates 108, 110. Each of the angled edges of the terminal plates 108, 110 (where the terminal plates 108, 110 connect to the elongated via columns 100*a*, 100*d*) has the same angular relationship with the elongated via columns 100*a*, 100*d* as each of the connector plates 104, 106*a*, 106*b* has with the elongated via columns 100*a*, 100*b*, 100*c*, 100*d*. These angular relationships allow the conductive path 94 to wrap symmetrically in three dimensions while preventing current crowding by maintaining substantially equal current paths.

Note then that each of the elongated via columns 100 has an interior column surface and an exterior column surface oppositely disposed from one another. For each of the elongated via columns 100, the interior column surface faces toward an interior of the 3D inductor 62B, while the exterior column surface faces toward an exterior of the 3D inductor 62B. As shown in FIG. 5, the plane 112*a* and the plane 112*c* are substantially parallel so that an interior column surface of the elongated via column 100*a* and an interior column surface of the elongated via column 100*c* face one another. Furthermore, the plane 112*b* and the plane 112*d* are substantially parallel so that the interior column surface of the elongated via column 100*b* and the interior column surface of the elongated via column 100*d* face one another. However, the plane 112*a* and the plane 112*c* are each transverse to both the plane 112*b* and the plane 112*d*. The planes 112*a*, 112*b*, 112*c*, and 36*d* thus all intersect at vertical side SA to define a square footprint and all intersect at vertical side SB to define another square footprint.

With regard to the embodiment of the 3D inductor 62B shown in FIG. 5, the conductive path 94 of the 2D lobe 96 extends from the terminal plate 108 to the terminal plate 110. The 2D lobe 96 is open so as to define a gap 114 in the 2D lobe 96 between the terminal plate 108 and the terminal plate 110. The 2D lobe 96 is formed such that the conductive path 94 extends out of the terminal plate 108 and loops back to the terminal plate 110 back towards the gap 114. The terminal plate 108 is connected to a connecting end of the elongated via column 100*a* at the side SA. In this embodiment, the conductive path 94 forms a first turn 116 of the 3D inductor 62B. To form the first turn 116, the connector plate 106*a* is connected to a connecting end of the elongated via column 100*a* at the side SB. Also, the connector plate 106*a* is connected to a connecting end of the elongated via column 100*b* at the vertical side SB. In this manner, the elongated via column 100*a*, the connector plate 106*a*, and the elongated via column 100*b* form the first turn 116. The connector plate 104 provides a bend that bounds the 2D lobe 96 so that the 2D lobe 96 curves back on itself. The connector plate 104 is connected to a connecting end of the elongated via column 100*c* at the vertical side SA. The conductive path 94 forms a second turn 118 of the 3D inductor 62B that loops the 2D lobe 96 back toward the gap 114 and the terminal plate 110. To form the second turn 118, the connector plate 106*b* is connected to a connecting end of the elongated via column 100*c* at the vertical side SB. The connector plate 106*b* is also connected to a connecting end of the elongated via column 100*d* at the vertical side SB. Thus, the elongated via column 100*c*, the connector plate 106*b*, and the elongated via column 100*d* form the second turn 118. Furthermore, note that the first turn 116 and the second turn 118 are connected to form a third turn 120. More specifically, the elongated via column 100*b*, the connector plate 104, and the elongated via column 100*c* form the third turn 120.

A magnetic field H is generated by the 3D inductor 62B in response to a current. The intensity and direction of the magnetic field is indicated by the size of the cones. By laying the 2D lobe 96 of the conductive path 94 of the 3D inductor 62B over the 3D volume 98, the conductive path 94 is configured to generate the magnetic field H that predominately embraces the conductive path 94 along an interior of the 3D inductor 62B. Thus, the magnetic field H predominately embraces the interior surfaces of the elongated via column 100*a*, the elongated via column 100*b*, the elongated via column 100*c*, the elongated via column 100*d*, the connector plate 104, the 3D volume 98, the terminal plate 108, and the terminal plate 110. The magnetic field H gets weaker towards a geometric centroid of the 3D inductor 62B. A majority of magnetic energy of the magnetic field H is stored inside the 3D inductor 62B and within the 3D volume 98. Also, the magnetic field lines of the magnetic field H are predominately destructive on an exterior of the 3D inductor 62B and the 3D volume 98 of the 3D inductor 62B. The magnetic field lines of the magnetic field H are predominately destructive outside the 3D inductor 62B and the 3D volume 98 because magnetic field line subtraction dominates outside the 3D inductor 62B and the 3D volume 98 so that a minority of the magnetic energy of the magnetic field H is stored outside of the 3D inductor 62B and the 3D volume 98.

As shown in FIG. 5, the 2D lobe 96 is laid over the 3D volume 98 such that the conductive path 94 extends in three orthogonal spatial dimensions. Thus, an RF signal propagates through conductive path 94 in three orthogonal spatial dimensions, and the conductive path 94 is a 3D conductive path. As such, all three spatial dimensions are required to describe signal propagation throughout the 2D lobe 96. Direction indicators are drawn throughout the conductive path 94 to indicate directions of current propagation throughout the 3D inductor 62B. The spreading of the magnetic field H in all three dimensions helps achieve weak coupling, since little energy is concentrated in any given direction.

An x-axis, a y-axis, and a z-axis are shown in FIG. 5 with an origin at a geometric centroid of the 3D inductor 62B and the 3D volume 98. As shown in FIG. 5, the first turn 116 and the second turn 118 face one another and are substantially symmetrical with respect to an x-z plane. The connector plate 104 connects the first turn 116 and the second turn 118 so that the third turn 120 faces the y-z plane, which is traverse to the x-z plane. The 3D inductor 62B does not have symmetry with respect to the x-y plane, which is orthogonal to both the x-z plane and the y-z plane. However, on one side of the x-y plane, the 3D inductor 62B is bounded, while on another side of the x-y plane, the 3D inductor 62B is unbounded.

Due to the symmetry of the 3D inductor 62B shown in FIG. 5, the 2D lobe 96 of the 3D inductor 62B is laid over the 3D volume 98 such that most inductor segments have a corresponding inductor segment in the 3D inductor 62B such that current propagation in the inductor segments is antipodal. For instance, except for the gap 114, inductor segments in the first turn 116 located on one side of the x-z plane have a corresponding inductor segment in the second turn 118 located on the other side of the x-z plane where current propagation is antipodal. Similarly, except for the gap 114, inductor segments in the third turn 120 located on one side of the y-z plane have a corresponding inductor segment relative to a segmented fourth turn 122 located on the other side of the y-z plane. The segmented fourth turn 122 is formed by the terminal plate 108, the elongated via column 100*a*, the elongated via column 100*d*, and the terminal plate 110. Accordingly, the magnetic field lines of the magnetic field H that predominately embrace the conductive path 94 are predominately subtractive (canceling partially or completely) outside the 3D inductor 62B. However, lack of symmetry with respect to the x-y plane ensures that this is not entirely the case throughout.

Note each of the substrate layers 66 has the top substrate layer surface 78T and the bottom substrate layer surface 78U, which is displaced vertically so as to define a thickness of the substrate layer 66. Thus, for each of the substrate layers 66, the top substrate layer surface 78T is oppositely disposed from the bottom substrate layer surface 78U. For each of the conductive vias 102, the conductive vias 102 extend vertically through the substrate layer 66 within which the conductive via 102 is formed. Thus, a depth of each of the conductive vias 102 is approximately equal to the thickness of the substrate layer 66 in which the conductive via 102 is formed. Accordingly, each of the substrate layers 66 thus includes four conductive vias 102 that have the same depth, one for each of the columns 100.

Each of the conductive vias 102 includes a via attachment surface 124T (not all labeled for the sake of clarity) and a via attachment surface 124U (not all labeled for the sake of clarity). The via attachment surface 124T is exposed by the top substrate layer surface 78T of the substrate layer 66 within which the conductive via 102 is formed. The via attachment surface 124T of each of the conductive vias 102 defines a via surface contour along a boundary of the via attachment surface 124T. In this example, the via attachment surface 124T of each of the conductive vias 102 has a stadium shape, which can be described as semicircles joined at opposite sides of a rectangle. Also, the via attachment surface 124U is exposed by the bottom substrate layer surface 78U of the substrate layer 66 within which the conductive via 102 is formed. The via attachment surface 124U of each of the conductive vias 102 has a stadium shape, which can be described as semicircles joined at opposite sides of a rectangle. In this embodiment, the via attachment surface 124T and the via attachment surface 124U both have the same shape.

Except for the conductive vias 102 connected to the connector plate 104 and the terminal plates 108, 110, the via attachment surface 124T of the conductive vias 102 within each of the columns 100 is attached to the via attachment surface 124U of the next highest conductive via 102. In column 100*a*, the via attachment surface 124T of the top conductive via 102 is attached to a bottom surface of the terminal plate 108. In column 100*b*, the via attachment surface 124T of the top conductive via 102 is attached to a bottom surface at one end of the connector plate 104. In column 100*c*, the via attachment surface 124T of the top conductive via 102 is attached to a bottom surface at the opposite end of the connector plate 104. In column 100*d*, the via attachment surface 124T of the top conductive via 102 is attached to a bottom surface of the terminal plate 110.

Except for the conductive vias 102 connected to the connector plates 106*a*, 106*b*, the via attachment surface 124U of the conductive vias 102 within each of the columns 100 is attached to the via attachment surface 124T of the lowest conductive via 102. Except for the conductive vias 102 connected to the connector plate 106*a*, 106*b*, the via attachment surface 124U of the conductive vias 102 within each of the columns 100 is attached to the via attachment surface 124T of the next lowest conductive via 102 within the column 100. In column 100*a*, the via attachment surface 124U of the bottom conductive via 102 is attached to a top surface at one end of the connector plate 106*a*. In column 100*b*, the via attachment surface 124U of the bottom conductive via 102 is attached to a top surface at the opposite end of the connector plate 106*a*. In column 100*c*, the via attachment surface 124U of the bottom conductive via 102 is attached to a top surface at one end of the connector plate 106*b*. In column 100*d*, the via attachment surface 124U of the bottom conductive via 102 is attached to a top surface at the opposite end of the connector plate 106*b*.

Note that for each of columns 100 and each pair of conductive vias 102 that has a via attachment surface 124T of one conductive via 102 attached to the via attachment surface 124U of the other conductive via 102, the via attachment surface 124T is attached to the via attachment surface 124U such that via surface contour of the via attachment surface 124U is substantially aligned with and is substantially the same as the via surface contour of the via attachment surface 124U. In this manner, current does not propagate horizontally and outside the contours of the conductive posts as the current propagates through each of the columns 100. In this embodiment, each of the substrate layers 66 are approximately the same thickness and thus each of the conductive vias 102 is approximately the same depth. Furthermore, note that there are no carrier pads between any of the conductive vias 102 in any of the columns 100.

Figure 6:
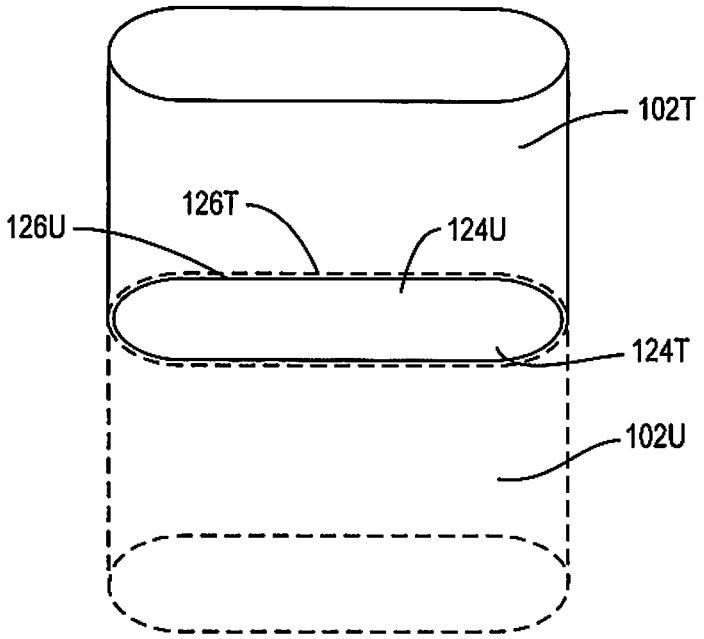
FIG. 6 illustrates the surface contours of the conductive vias in the via columns shown in FIG. 5.

FIG. 6 illustrates a transparent view of an embodiment of a conductive via 102T (drawn with solid lines) stacked on a conductive via 102U (drawn with dotted lines). The via attachment surface 124U of the conductive via 102T is attached to the via attachment surface 124T of the conductive via 102U. Note that every pair of conductive vias 102 (shown in FIG. 5) in every column 100 (shown in FIG. 5) having the via attachment surface 124U attached to the via attachment surface 124T may be provided as shown in FIG. 6. Since the conductive via 102T only includes a conductive post and the conductive via 102U only includes a conductive post, no carrier pad is provided. As shown in FIG. 6, the via attachment surface 124U of the conductive via 102T is provided at a horizontal surface of a bottom end of the conductive post. The via attachment surface 124T of the conductive via 102U is provided at a horizontal surface of a top end of the conductive post. The via attachment surface 124U of the conductive via 102T defines a via surface contour 126U (drawn as solid lines) along a boundary of the via attachment surface 124U. The via attachment surface 124T of the conductive via 102U defines a via surface contour 126T (drawn as dotted lines) along the boundary of the via attachment surface 124U. The surface contour 126U is substantially aligned with and is substantially the same as the surface contour 126T. As such, there is not overhang between the via attachment surface 124U and the via attachment surface 124U. In this manner, current does not flow horizontally as the current propagates between the conductive via 102U and the conductive via 102T.

Figure 7A:
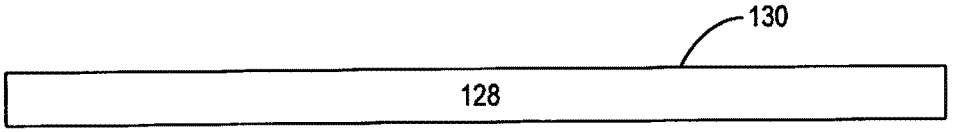
FIGS. 7A-7Q illustrates an exemplary method of manufacturing the 3D inductors shown in FIG. 3 and FIG. 5.
Figure 7B:
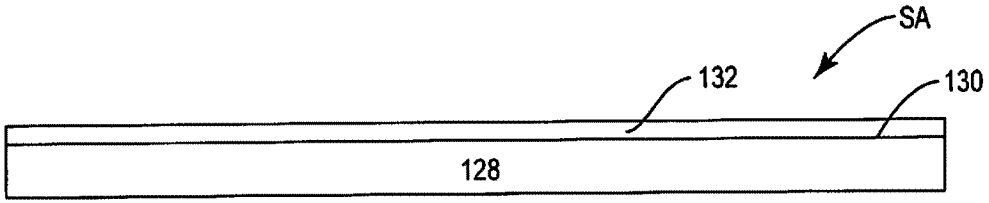
Figure 7C:
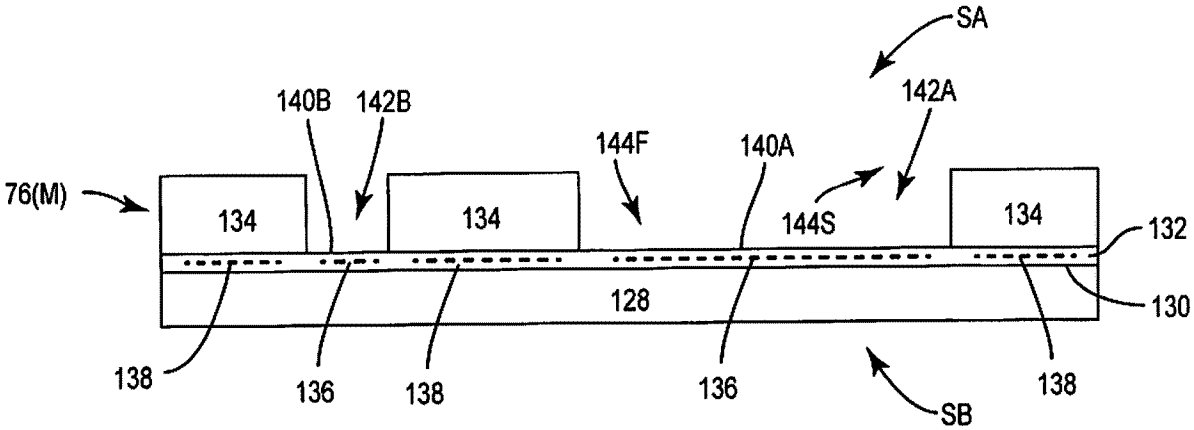
Figure 7D:
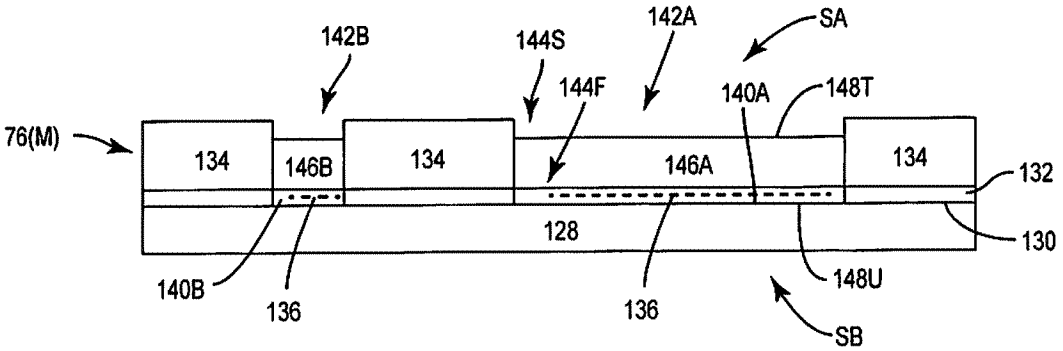
Figure 7E:
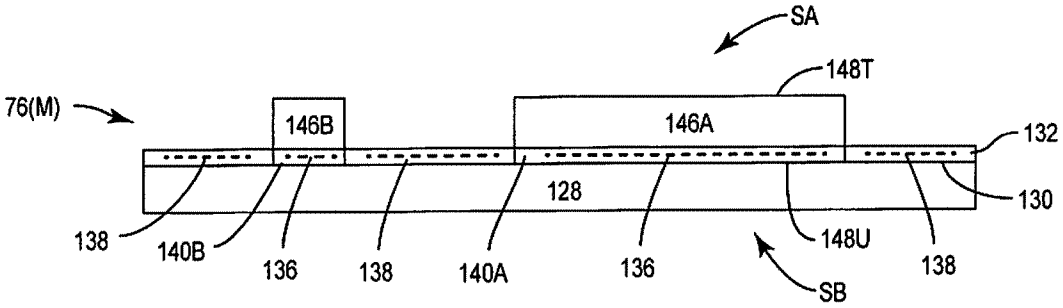
Figure 7F:
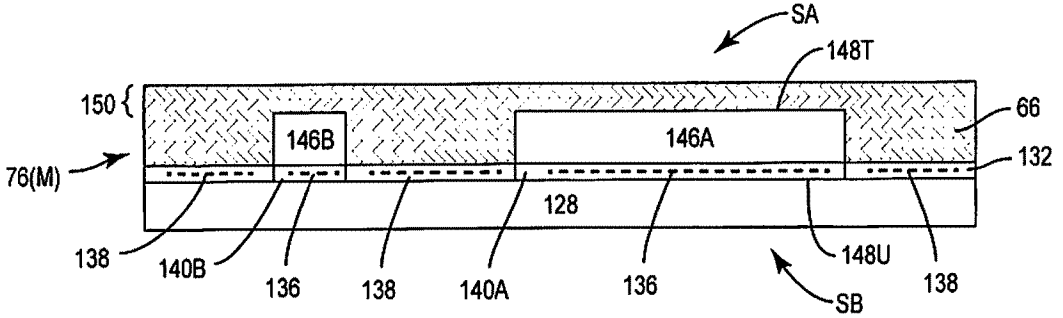
Figure 7G:
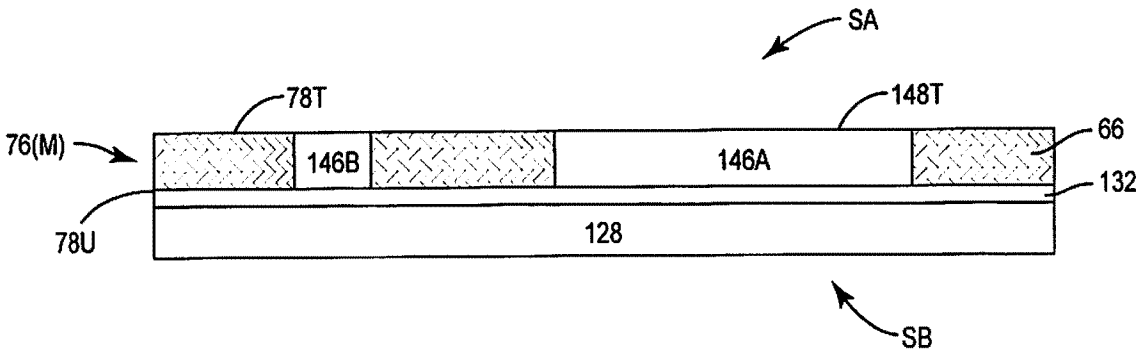
Figure 7H:
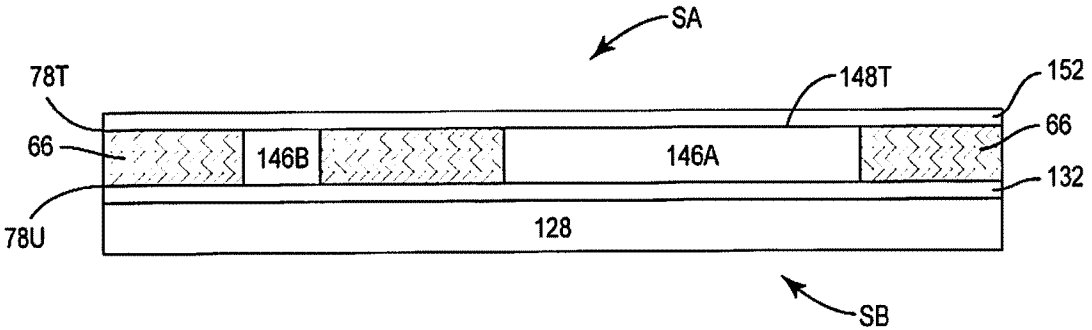
Figure 7I:
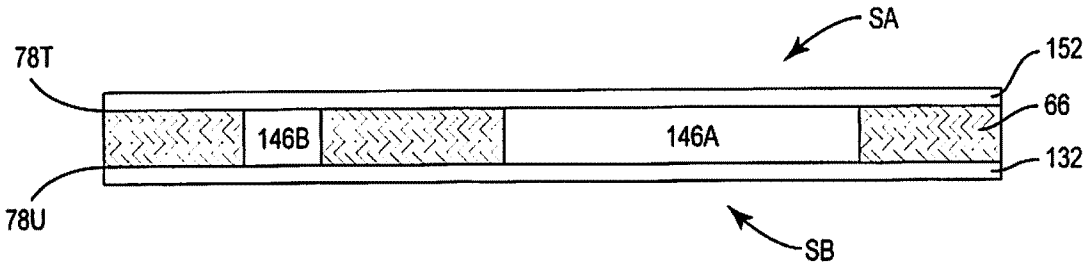
Figure 7J:
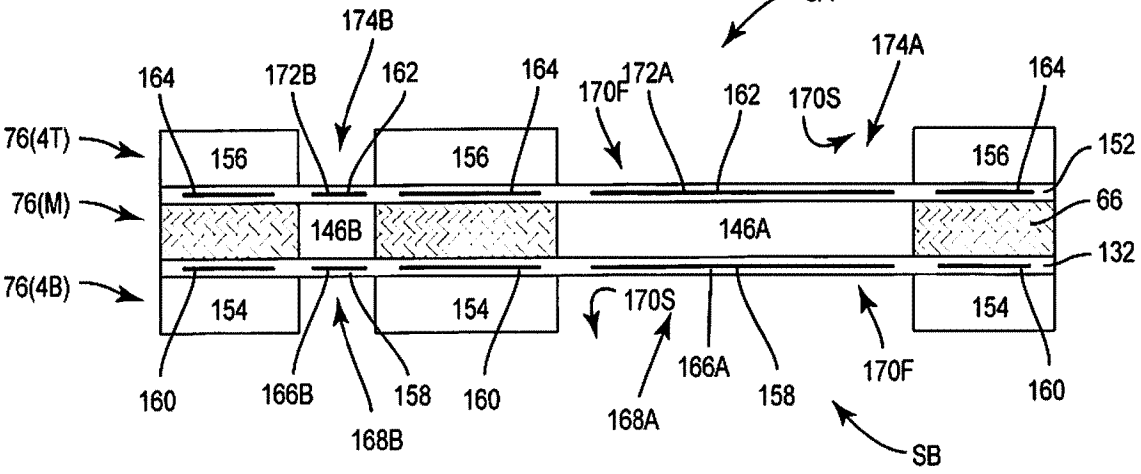
Figure 7K:
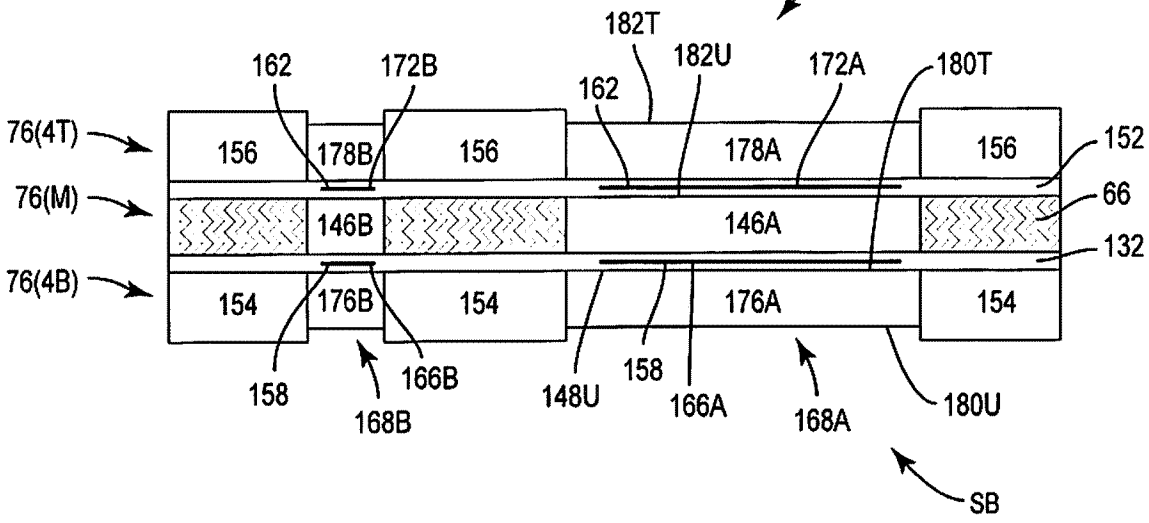
Figure 7L:
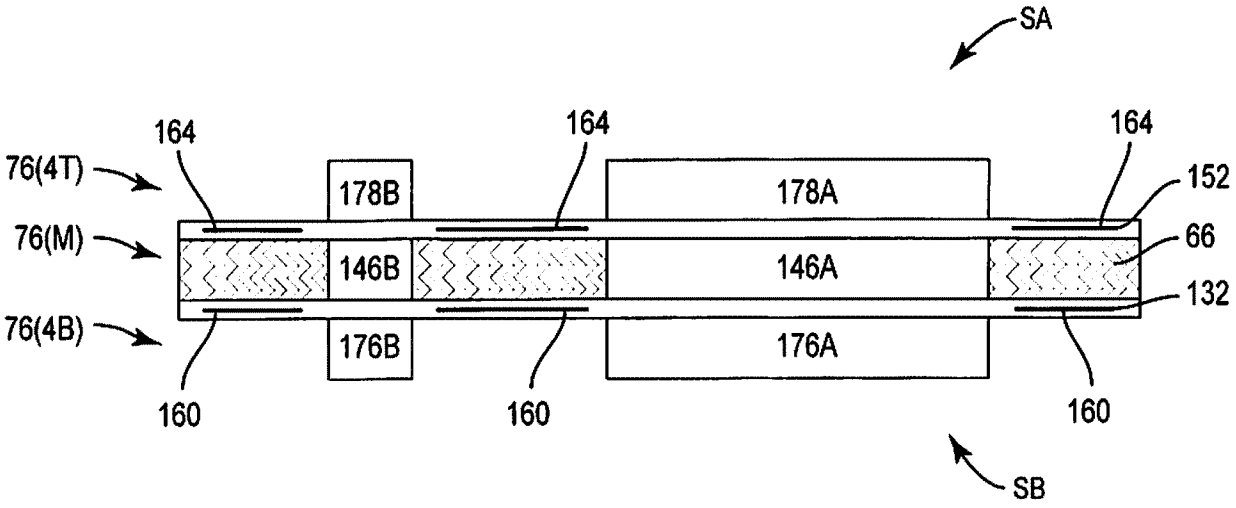
Figure 7M:
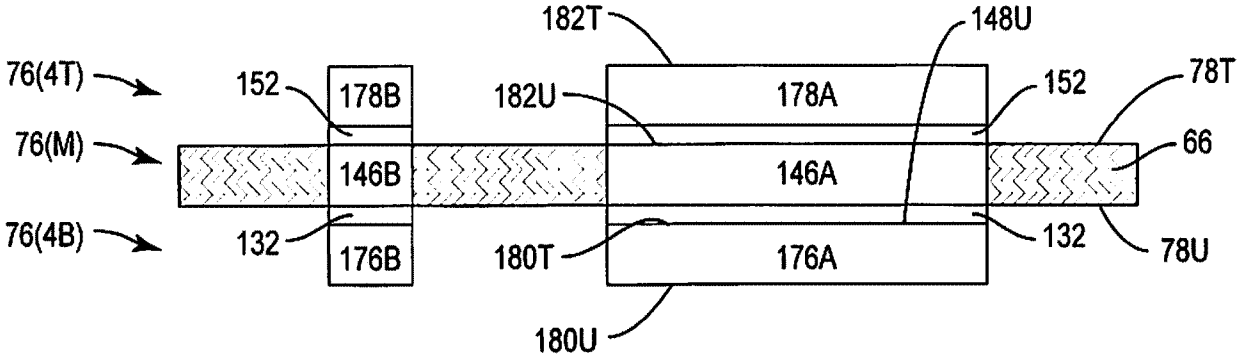
Figure 7N:
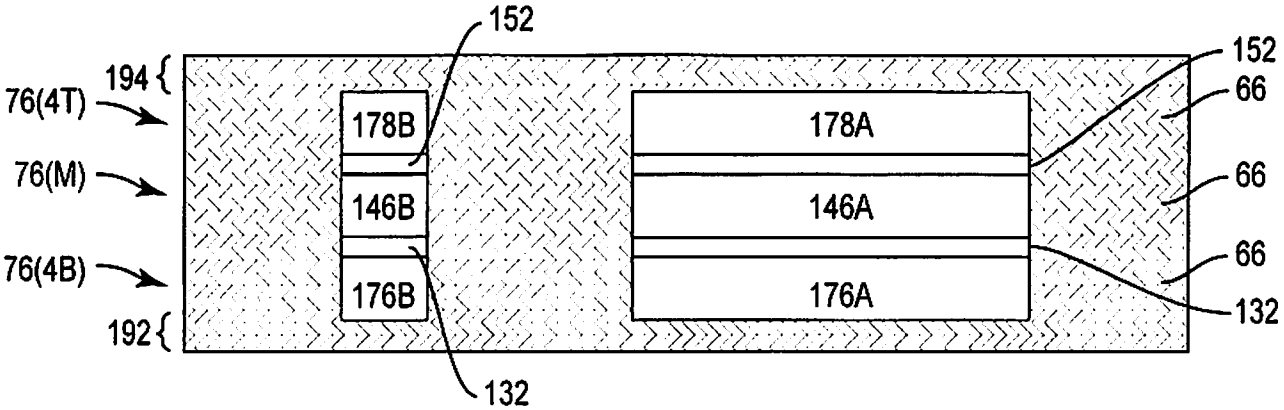
Figure 7O:
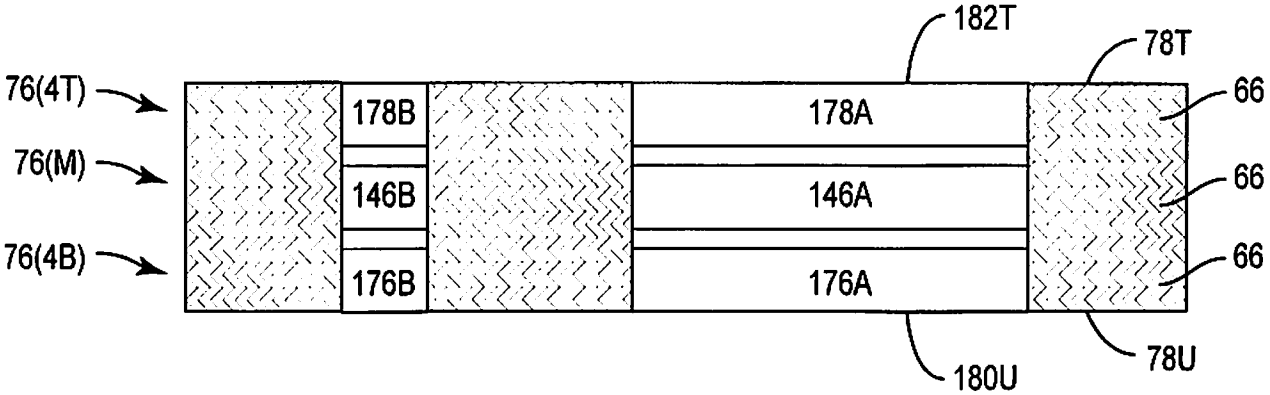
Figure 7P:
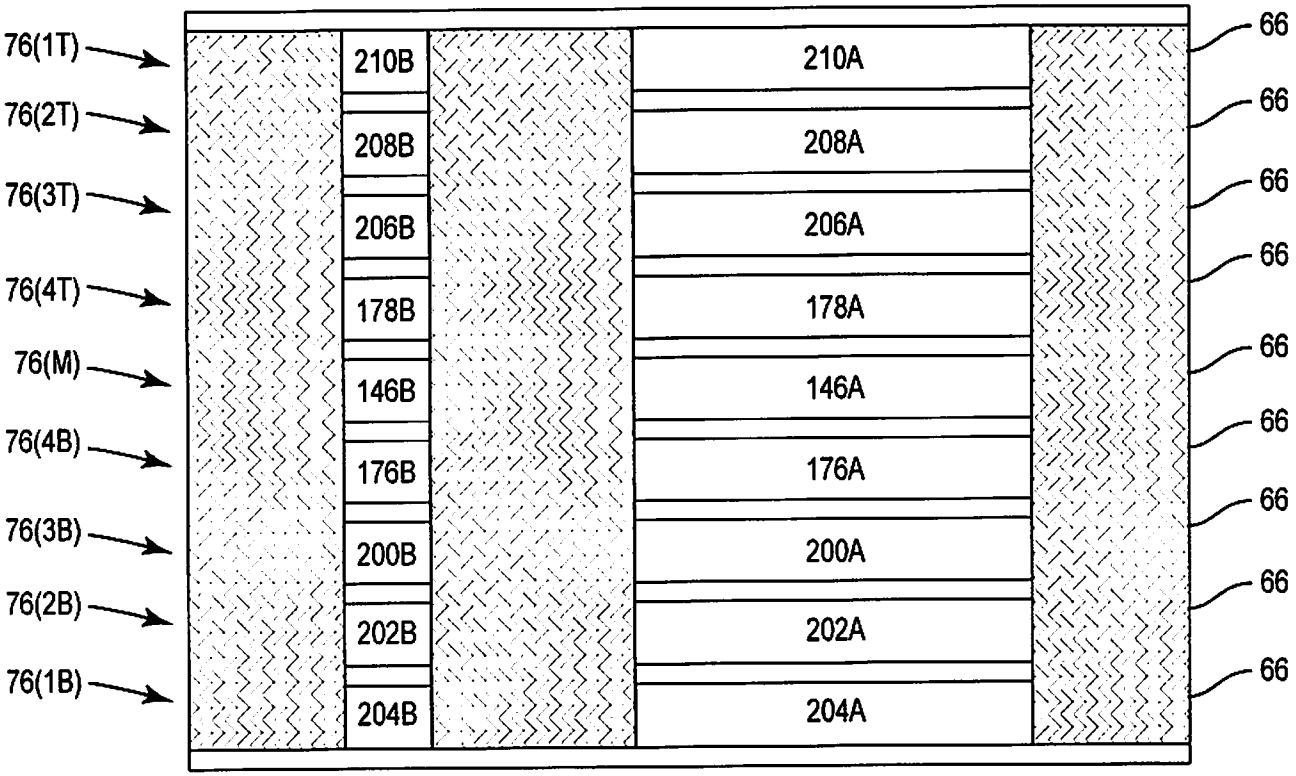
Figure 7Q:
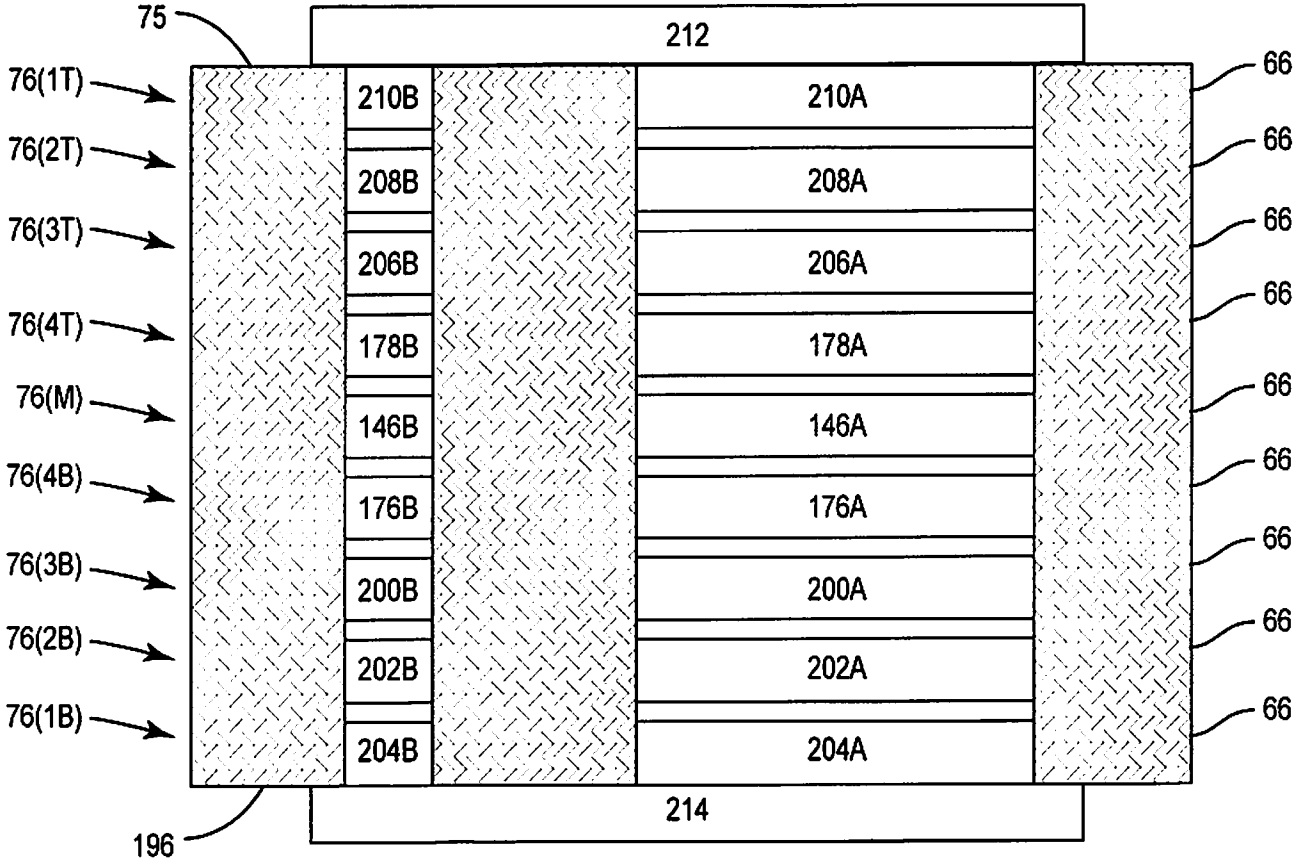

FIGS. 7A-7Q illustrate steps for forming the substrate 58, which may be provided as shown in FIG. 3 or in FIG. 5 as discussed in further detail below. In FIG. 7A, a carrier 128 is provided. The carrier 128 has a primary surface 130. The carrier 128 provides the base so that the substrate layer 66 (shown in FIGS. 3 and 5) at the vertical level 76(M) (shown in FIGS. 3 and 5) and conductive components within the substrate layer 66 (shown in FIGS. 3 and 5) at the vertical level 76(M) (shown in FIGS. 3 and 5) can be formed. The carrier 128 is formed from a non-conductive material that is suitable to form conductive components through a plating process, as explained in further detail below. Next, a plating foil 132 is formed over the primary surface 130 of the carrier 128 (FIG. 7B). Thus, the plating foil 132 covers the carrier 128 from the first vertical side SA. The plating foil 132 may be formed of any material or any suitable combination of materials that allows for electrolytic or electroless plating. For example, the plating foil 132 may be formed from electroless or electrolytic copper (Cu).

Next, a mask 134 is placed over the plating foil 132 (FIG. 7C). The mask 134 exposes a first portion 136 of the plating foil 132 while covering a second portion 138 of the plating foil 132. The first portion 136 of the plating foil 132 is where conductive components within the substrate layer 66 at the vertical level 76(M) (shown in FIGS. 3 and 5) are to be formed. The second portion 138 covered by the mask 134 is in the shaped in accordance with the substrate layer 66 to be formed at the vertical level 76(M) (shown in FIGS. 3 and 5).

As shown in FIG. 7C, the first portion 136 exposed by the mask 134 includes different sections (referred to generically as sections 140 and specifically as sections 140A-140B). More specifically, the mask 134 includes apertures (referred to generically as apertures 142 and specifically as apertures 142A-142B). The apertures 142 of the mask expose the sections 140 of the plating foil 132 from the first vertical side SA. The mask 134 is patterned so that the apertures 142 are shaped to form the conductive components of the substrate layer 66 (shown in FIGS. 3 and 5) at vertical level 76(M). The mask 134 is aligned so that each of the apertures 142 are provided to expose the sections 140 where the conductive components in the vertical level 76(M) are to be provided.

For example, the aperture 142A exposes the section 140A, which is where a conductive component of a 3D inductor is to be formed. As shown in FIG. 7C, a front side opening 144F of the aperture 142A is defined at the front side of the mask 134. The front side of a mask, including the mask 134, is the attached side of the mask. The front side opening 144F has an opening contour that substantially is the same as a surface contour on the bottom surface of the conductive component to be formed. The mask 134 is placed to position the front side opening 144F so that the bottom surface or a section of the bottom surface is substantially aligned with a top surface or a section of the top surface of a conductive component that is to be provided within the substrate layer 66 (shown in FIGS. 3 and 5) at the vertical level 76(4B) (shown in FIGS. 3 and 5). Also, the aperture 142A of the mask 134 defines a back side opening 144S at the back side of the mask 134. The back side of a mask, including the mask 134, is oppositely disposed from the front side and is at the side of the mask that is accessible, which for the mask 134 is the first vertical side SA. The back side opening 144S has an opening contour that is substantially the same as a surface contour of the top surface of the conductive component to be formed. The mask 134 is placed to position the back side opening 144S so that the top surface or a section of the top surface is substantially aligned with a bottom surface or a section of the bottom surface of a conductive component that is to be provided within the substrate layer 66 (shown in FIGS. 3 and 5) at the vertical level 76(4T) (shown in FIGS. 3 and 5). Note that in this embodiment, the opening contour of the front side opening 144F is the same as the opening contour of the back side opening 144S. In alternative embodiments, the aperture 142A may be provided in any shape and with a varying aspect ratio. As such, in alternative embodiments, the opening contour of the front side opening 144F and the opening contour of the back side opening 144S may be different in accordance with a desired shape for the conductive component.

To form the 3D inductor 62A shown in FIG. 3, the conductive component to be formed is the winding 68 at the vertical level 76(M). In this case, the aperture 142A is shaped as the winding 68 (shown in FIG. 3), and the section 140A that is exposed by the aperture 142A is shaped as the winding surface 80U (shown in FIG. 4A). The aperture 142A of the mask 134 is thus shaped as the winding 68 (shown in FIG. 3) at the vertical level 76(M). As a result, the opening contour of the front side opening 144F of the aperture 142A is substantially the same as the winding surface contour 91U (shown in FIG. 4A). Furthermore, the segment of the aperture 142A that is to form the winding end 82F (shown in FIG. 4A) has the exterior edge contour 92U (shown in FIG. 4A). Additionally, the mask 134 is placed so that the section 140A is substantially aligned with the via attachment surface 86T (shown in FIG. 4A) of the conductive via 70 (shown in FIG. 3) within the substrate layer 66 (shown in FIG. 3) at the vertical level 76(4B) (shown in FIG. 3). As such, the front side opening 144F is shaped and positioned so that the exterior edge contour 92U (shown in FIG. 4A) of the winding end surface section 84U (shown in FIG. 4A) is substantially aligned with the exterior edge contour 90T of the via surface contour 88T of the via attachment surface 86T.

The back side opening 144S of the aperture 142A is substantially the same as the winding surface contour 91T (shown in FIG. 4B). Furthermore the segment of the aperture 142A that is to form the winding end 82S (shown in FIG. 4B) has the exterior edge contour 92T (shown in FIG. 4B). Furthermore, the mask 134 is placed so that the section 140A is substantially aligned with the via attachment surface 86U (shown in FIG. 4B) of the conductive via 70 (shown in FIG. 3) within the substrate layer 66 (shown in FIG. 3) at the vertical level 76(4T) (shown in FIG. 3). As such, the back side opening 144S is shaped and positioned so that the exterior edge contour 92T (shown in FIG. 4B) of the winding end surface section 84T (shown in FIG. 4B) is substantially aligned with the exterior edge contour 90U of the via surface contour 88U of the via attachment surface 86U.

To form the 3D inductor 62B shown in FIG. 5, the conductive component to be formed is the conductive via 102 (shown in FIG. 5) of one of the columns 100 (shown in FIG. 5) at the vertical level 76(M). Note that the mask 134 includes other apertures (not explicitly shown in FIG. 7C) that expose other sections of the plating foil 132 so as to form the other three conductive vias 102 in the other columns at the vertical level 76(M), as shown in FIG. 5. In this case, the aperture 142A is shaped as the conductive via 102T (shown in FIG. 6). The opening contour of the front side opening 144F is substantially the same as the via surface contour 126U (shown in FIG. 6) of the via attachment surface 124U (shown in FIG. 6) and thus is also substantially the same as the via surface contour 126T (shown in FIG. 6) of the via attachment surface 124T (shown in FIG. 6) of the conductive via 102U (shown in FIG. 6). Furthermore, the front side opening 144F is positioned so that the via attachment surface 124U (shown in FIG. 6) is formed so as to be substantially aligned with the via surface contour 126T (shown in FIG. 6) of the conductive via 102 (shown in FIG. 5) formed within the substrate layer 66 (shown in FIG. 5) at the vertical level 76(4B) (shown in FIG. 5).

The opening contour of the back side opening 144S is substantially the same as the via surface contour 126T (shown in FIG. 6) of the via attachment surface 124T (shown in FIG. 6) and thus is also substantially the same as the via surface contour 126U (shown in FIG. 6) of the via attachment surface 124U (shown in FIG. 6) of the conductive via 102T (shown in FIG. 6). Furthermore, the back side opening 144S is positioned so that the via attachment surface 124T (shown in FIG. 6) is formed so as to be substantially aligned with the via surface contour 126U (shown in FIG. 6) of the conductive via 102 (shown in FIG. 5) formed within the substrate layer 66 (shown in FIG. 5) at the vertical level 76(4T) (shown in FIG. 5).

Next, a conductive material is plated on the first portion 136 of the plating foil 132 exposed by the mask 134 (FIG. 7D). Thus, the conductive material fills the apertures 142 to form the conductive components (referred to generically as conductive components 146 and specifically as conductive components 146A-146B) of the vertical level 76(M). Thus, plating the section 140A and filling the aperture 142A with the conductive material forms a conductive component 146A of the inductor. For example, the conductive material may be a metallic material. Plating may be performed through either an electrolytic or an electroless plating process. In one implementation, the conductive material is copper (Cu) and plating is performed through an electrolytic copper (Cu) plating process or an electroless copper (Cu) plating process.

The conductive component 146A has a bottom component surface 148U and a top component surface 148T. The conductive component 146A is thus shaped as the aperture 142A. Accordingly, the section 140A of the plating foil 132 is integrated into the conductive component 146A and provides the bottom component surface 148U of the conductive component 146A. As a result of the opening contour of the front side opening 144F, the bottom component surface 148U has the surface contour, which is substantially the same as the opening contour. The top component surface 148T of the conductive component 146A is exposed from the back side of the mask 134. The top component surface 148T has the surface contour, which is substantially the same as the opening contour of the back side opening 144S of the aperture 142A. Accordingly, in this embodiment, the surface contour of the bottom component surface 148U and the surface contour of the top component surface 148T are substantially the same. However, in alternative embodiments, the surface contour of the bottom component surface 148U and the surface contour of the top component surface 148T may be different based on the shape of the conductive component 146A.

To form the 3D inductor 62A shown in FIG. 3, the conductive component 146A within the aperture 142A is the winding 68 (shown in FIG. 3) at the vertical level 76(M). The bottom component surface 148U of the conductive component 146A is the winding surface 80U (shown in FIG. 4A) of the winding 68 (shown in FIG. 3) at the vertical level 76(M). The top component surface 148T of the conductive component 146A is the winding surface 80T the winding 68 (shown in FIG. 3) at the vertical level 76(M). The aperture 142A of the mask 134 is thus shaped as the winding 68 (shown in FIG. 3) at the vertical level 76(M). The section 140A of the plating foil 132 is integrated and provides the winding surface 80U (shown in FIG. 4A). As a result of the opening contour of the front side opening 144F of the aperture 142A, the winding surface 80U (shown in FIG. 4A) defines the winding surface contour 91U (shown in FIG. 4A). Furthermore, the winding end 82F (shown in FIG. 4A) has the winding end surface section 84U with the exterior edge contour 92U (shown in FIG. 4A). The exterior edge contour 92U (shown in FIG. 4A) of the winding end 82F (shown in FIG. 4A) is thus substantially the same as the exterior edge contour 90T (shown in FIG. 4A) of the conductive via 70 (shown in FIG. 3) to be formed within the substrate layer 66 (shown in FIG. 3) at the vertical level 76(4B) (shown in FIG. 3). The winding end 82F is also positioned so that the exterior edge contour 92U (shown in FIG. 4A) of the winding end 82F (shown in FIG. 4A) is thus substantially aligned with the exterior edge contour 90T (shown in FIG. 4A) of the conductive via 70 (shown in FIG. 3) to be formed within the substrate layer 66 (shown in FIG. 3) at the vertical level 76(4B) (shown in FIG. 3). As such, the section 140A is shaped and positioned so that the exterior edge contour 92U (shown in FIG. 4A) of the winding end surface section 84U (shown in FIG. 4A) is substantially aligned with the exterior edge contour 90T (shown in FIG. 4A) of the via surface contour 88T (shown in FIG. 4A) of the via attachment surface 86T (shown in FIG. 4A).

The top component surface 148T of the conductive component 146A is the winding surface 80T (shown in FIG. 4B). As a result of the opening contour of the back side opening 144S of the aperture 142A, the winding surface 80T (shown in FIG. 4B) defines the winding surface contour 91T (shown in FIG. 4B). Furthermore, the winding end 82S (shown in FIG. 4B) has the winding end surface section 84T with the exterior edge contour 92T (shown in FIG. 4B). The exterior edge contour 92T (shown in FIG. 4B) of the winding end 82S (shown in FIG. 4B) is thus substantially the same as the exterior edge contour 90U (shown in FIG. 4B) of the conductive via 70 (shown in FIG. 3) to be formed within the substrate layer 66 (shown in FIG. 3) at the vertical level 76(4T) (shown in FIG. 3). The winding end 82S is also positioned so that the exterior edge contour 92T (shown in FIG. 4B) of the winding end 82S (shown in FIG. 4B) is thus substantially aligned with the exterior edge contour 90U (shown in FIG. 4B) of the conductive via 70 (shown in FIG. 3) to be formed within the substrate layer 66 (shown in FIG. 3) at the vertical level 76(4T) (shown in FIG. 3). As such, the top component surface 148T is shaped and positioned so that the exterior edge contour 92T (shown in FIG. 4B) of the winding end surface section 84T (shown in FIG. 4B) is substantially aligned with the exterior edge contour 90U (shown in FIG. 4B) of the via surface contour 88U (shown in FIG. 4B) of the via attachment surface 86T (shown in FIG. 4B).

To form the 3D inductor 62B shown in FIG. 5, the conductive component 146A within the aperture 142A is the conductive via 102 (shown in FIG. 5) of one of the columns 100 (shown in FIG. 5) at the vertical level 76(M). Note that within other apertures (not explicitly shown in FIG. 7D), the other three conductive vias 102 (shown in FIG. 5) at the vertical level 76(M) in the other columns 100 (shown in FIG. 5) are formed. The aperture 142A is thus shaped as the conductive via 102 (shown in FIG. 5). Accordingly, the section 140A of the plating foil 132 is integrated into the conductive via 102 (shown in FIG. 5) to provide the bottom component surface 148U and the via attachment surface 124U (shown in FIG. 6). The via attachment surface 124U (shown in FIG. 6) of the via attachment surface 124U (shown in FIG. 6) is also substantially the same as the via surface contour 126T (shown in FIG. 6) of the via attachment surface 124T (shown in FIG. 6) of the conductive via 102 (shown in FIG. 5) to be formed within the substrate layer 66 (shown in FIG. 5) at the vertical level 76(4B) (shown in FIG. 5). Furthermore, due to alignment of the front side opening 144F, the via attachment surface 124U (shown in FIG. 6) is formed so as to be substantially aligned with the via surface contour 126T (shown in FIG. 6) of the conductive via 102 (shown in FIG. 5) formed within the substrate layer 66 (shown in FIG. 5) at the vertical level 76(4B) (shown in FIG. 5).

Also, in this case, the top component surface 148T is the via attachment surface 124T (shown in FIG. 6) of the conductive via 102 (shown in FIG. 5) at the vertical level 76(M). The via attachment surface 124T (shown in FIG. 6) of the via attachment surface 124T (shown in FIG. 6) is also substantially the same as the via surface contour 126U (shown in FIG. 6) of the via attachment surface 124U (shown in FIG. 6) of the conductive via 102 (shown in FIG. 5) to be formed within the substrate layer 66 (shown in FIG. 5) at the vertical level 76(4T) (shown in FIG. 5). Furthermore, due to alignment of the back side opening 144S, the via attachment surface 124T (shown in FIG. 6) is formed so as to be substantially aligned with the via surface contour 126U (shown in FIG. 6) of the conductive via 102 (shown in FIG. 5) formed within the substrate layer 66 (shown in FIG. 5) at the vertical level 76(4T) (shown in FIG. 5).

After plating, the mask 134 (shown in FIG. 7D) is removed from the plating foil 132 (FIG. 7E). The mask 134 may be removed using a chemical etchant. As shown in FIG. 7E, the first portion 136 of the plating foil 132 is covered by the conductive components 146 from the first vertical side SA while the second portion 138 (which was covered previously covered by the removed mask 134) is exposed from the first vertical side SA after the mask 134 (shown in FIG. 7D) is removed. Thus, the bottom component surface 148U of the conductive component 146A is covered from the first vertical side SA by the conductive component 146A. The top component surface 148T is exposed from the first vertical side SA.

Next, the substrate layer 66 at the vertical level 76(M) is formed over the plating foil 132 that is exposed after removing the mask 134 and the conductive components 146 (FIG. 7F). In one embodiment, the substrate layer 66 is formed from a laminated material and is a laminate layer. The substrate layer 66 covers the second portion 138 of the plating foil 132 from the first vertical side SA and the top surfaces of the conductive components 146, including the top component surface 148T of the conductive component 146A. More specifically, a segment 150 of the substrate layer 66 at the vertical level 76(M) covers the top component surface 148T of the conductive component 146A from the first vertical side SA. With regard to the 3D inductor 62A shown in FIG. 3, the top component surface 148T is the winding surface 80T (shown in FIG. 4B) of the winding 68 (shown in FIG. 3) within the substrate layer 66 at the vertical level 76(M). With regard to the 3D inductor 62B shown in FIG. 5, the top component surface 148T is the via attachment surface 124T (shown in FIG. 6) of the conductive via 102 (shown in FIG. 6) within the substrate layer 66 at the vertical level 76(M).

Next, the top component surface 148T is exposed from the substrate layer 66 (FIG. 7G). As such, a segment 150 (shown in FIG. 7F) of the substrate layer 66 is removed so as to expose the top component surfaces of the conductive components 146 from the first vertical side SA. This may be done by grinding the substrate layer 66 to remove the segment 150 (shown in FIG. 7F). As such, the top component surface 148T of the conductive component 146A is exposed by the top substrate layer surface 78T of the substrate layer 66 from the first vertical side SA.

As shown in FIG. 7G, the plating foil 132 is covered by the substrate layer 66 from the first vertical side SA and is covered by the carrier 128 from a second vertical side SB. The second vertical side SB is oppositely disposed from the first vertical side SA. Nevertheless, the bottom component surfaces of the conductive components 146, including the bottom component surface 148U of the conductive component 146A are exposed by the bottom substrate layer surface 78U of the substrate layer 66. With regard to the 3D inductor 62A shown in FIG. 3, the winding surface 80T (shown in FIG. 4B) of the winding 68 (shown in FIG. 3) within the substrate layer 66 at the vertical level 76(M) is exposed by the top substrate layer surface 78T from the first vertical side SA. In this manner, the substrate layer 66 at the vertical level 76(M) is provided having the winding 68 (shown in FIG. 3) within the substrate layer 66 at the vertical level 76(M). The winding 68 (shown in FIG. 3) has the winding end 82S (shown in FIG. 4B) and the winding end surface section 84T (shown in FIG. 4B) provided by the winding surface 80T (shown in FIG. 4B).

With regard to the 3D inductor 62B shown in FIG. 5, the via attachment surface 124T (shown in FIG. 6) of the conductive via 120 (shown in FIG. 5) within the substrate layer 66 at the vertical level 76(M) is exposed by the top substrate layer surface 78T from the first vertical side SA. The substrate layer 66 at the vertical level 76(M) is provided having the conductive via 102 (shown in FIG. 5) within the substrate layer 66. The conductive via 102 (shown in FIG. 5) extends through the substrate layer 66 at the vertical level 76(M) to expose the via attachment surface 124T (shown in FIG. 6) at the top substrate layer surface 78T.

Next, a plating foil 152 is formed on the top substrate layer surface 78T of the substrate layer 66 and on the top component surfaces of the conductive components 146 (FIG. 7H). As such, the top substrate layer surface 78T of the substrate layer 66 at the vertical level 76(M) is covered by the plating foil 152. The plating foil 152 also covers the top component surface 148T of the conductive component 146A. With regard to the 3D inductor 62A shown in FIG. 3, the winding surface 80T (shown in FIG. 4B) of the winding 68 (shown in FIG. 3) within the substrate layer 66 at the vertical level 76(M) is covered by the plating foil 152 from the first vertical side SA. With regard to the 3D inductor 62B shown in FIG. 5, the via attachment surface 124T (shown in FIG. 6) of the conductive via 102 (shown in FIG. 5) within the substrate layer 66 at the vertical level 76(M) is covered by the plating foil 152 from the first vertical side SA.

The plating foil 152 may be formed of any material or any suitable combination of materials that allows for electrolytic or electroless plating. For example, the plating foil 152 may be formed from electroless or electrolytic copper (Cu). The carrier 128 (shown in FIG. 7H) is then removed (FIG. 7I). As such, the plating foil 132 is exposed from the second vertical side SB.

Next, a mask 154 is placed on the plating foil 132 from the second vertical side SB and a mask 156 is placed on the plating foil 152 from the first vertical side SA (FIG. 7J). The mask 154 exposes a first portion 158 of the plating foil 132 from the second vertical side SB of the substrate 58 while covering a second portion 160 of the plating foil 152 from the second vertical side SB of the substrate 58. The first portion 158 of the plating foil 152 is where conductive components within the substrate layer 66 at the vertical level 76(4B) (shown in FIGS. 3 and 5) are to be formed. The second portion 160 covered by the mask 154 is shaped in accordance with the substrate layer 66 to be formed at the vertical level 76(4B) (shown in FIGS. 3 and 5).

The mask 156 exposes a first portion 162 of the plating foil 152 from the first vertical side SA of the substrate 58 while covering a second portion 164 of the plating foil 152 from the first vertical side SA. The first portion 162 of the plating foil 152 is where conductive components within the substrate layer 66 at the vertical level 76(4T) (shown in FIGS. 3 and 5) are to be formed. The second portion 164 covered by the mask 156 from the first vertical side SA of the substrate 58 is shaped in accordance with the substrate layer 66 to be formed at the vertical level 76(4T) (shown in FIGS. 3 and 5).

As shown in FIG. 7J, the first portion 158 exposed by the mask 154 includes different sections (referred to generically as sections 166 and specifically as sections 166A-166B). More specifically, the mask 154 includes apertures (referred to generically as apertures 168 and specifically as apertures 168A-168B). The apertures 168 of the mask expose the sections 166 of the plating foil 132. The mask 154 is patterned so that the apertures 168 are shaped to form the conductive components of the substrate layer 66 at vertical level 76(4B). The mask 154 is aligned so that each of the apertures 168 is provided to expose the sections 166 where the conductive components in the vertical level 76(3B) (shown in FIG. 3 and FIG. 5) are to be provided. For example, the aperture 168A exposes the section 166A, which is where a conductive component of an inductor is to be formed. As shown in FIG. 7J, a front side opening 170F of the aperture 168A is defined at the front side of the mask 154. The front side opening 170F has an opening contour that substantially is the same as a surface contour on the top surface of the conductive component to be formed. Also, the aperture of the mask 154 defines a back side opening 170S at the back side of the mask 154. The back side opening 170S has an opening contour that is substantially the same as a surface contour of the bottom surface of the conductive component to be formed. Note that in this embodiment, the opening contour of the front side opening 170F is the same as the opening contour of the back side opening 170S. In alternative embodiments, the aperture 168A may be provided in any shape and with a varying aspect ratio. As such, in alternative embodiments, the opening contour and the opening contour may be different in accordance with a desired shape for the conductive component.

With regard to the 3D inductor 62A shown in FIG. 3, the conductive component to be formed is the conductive via 70 at the vertical level 76(4B). In this case, the aperture 168A is shaped as the conductive via 70 (shown in FIG. 3) and the section 166A that is exposed by the aperture 168A is shaped as the via attachment surface 86T (shown in FIG. 4A). The mask 154 is positioned such that the aperture 168A is aligned with the section 166A of the plating foil 132. The section 166A is on the winding end surface section 84U (shown in FIG. 4A) provided by the winding surface 80U (shown in FIG. 4A) of the winding end 82F (shown in FIG. 3) of the winding 68 at the vertical level 76(M). The opening contour of the front side opening 170F of the mask 154 is thus substantially the same as the via attachment surface 86T (shown in FIG. 4A) of the conductive via 70 (shown in FIG. 3). The opening contour of the back side opening 170S of the mask 154 is thus substantially the same as the surface contour 88U (shown in FIG. 4B) of via attachment surface 86U (shown in FIG. 4B).

With regard to the 3D inductor 62B shown in FIG. 6, the conductive component to be formed is the conductive via 102 at the vertical level 76(4B) of one of the columns 100. Note that the mask 154 includes other apertures (not explicitly shown in FIG. 7J) that expose other sections of the plating foil so as to form the other three conductive vias 102 in the other columns at the vertical level 76(4B), as shown in FIG. 5. In this case, the aperture 168A is shaped as the conductive via 102U (shown in FIG. 6) and the section 166A that is exposed by the aperture 168A is shaped as the via attachment surface 124T (shown in FIG. 6) of the conductive via 102U in FIG. 6. In this case, the section 140A forms the via attachment surface 124U of the conductive via 102T at the vertical level 76(M). The aperture 168A is thus substantially aligned with the via attachment surface 124U of the conductive via 102 at the 76(M). The opening contour of the front side opening 170F of the mask 154 is thus substantially the same as the via attachment surface 124T of the conductive via 102U in FIG. 7. The opening contour of the back side opening 170S of the mask 154 is thus substantially the same as the via attachment surface 124U of the conductive via 102T in FIG. 7.

As shown in FIG. 7J, the first portion 162 exposed by the mask 156 includes different sections (referred to generically as sections 172 and specifically as sections 172A-172B). More specifically, the mask 156 includes apertures (referred to generically as apertures 174 and specifically as apertures 174A-174B). The apertures 174 of the mask expose the sections 172 of the plating foil 132. The mask 156 is patterned so that the apertures 174 are shaped to form the conductive components of the substrate layer 66 at vertical level 76(4T). The mask 156 is aligned so that each of the apertures 174 is provided to expose the sections 172 where the conductive components in the vertical level 76(3T) are to be provided. For example, the aperture 174A exposes the section 172A, which is where a conductive component of an inductor is to be formed. As shown in FIG. 7J, a front side opening 170F of the aperture 174A is defined at the front side 172F of the mask 156. The front side opening 170F has an opening contour that substantially is the same as a surface contour on the top surface of the conductive component to be formed. Also, the aperture of the mask 156 defines a back side opening 170S at the back side of the mask 156. The back side opening 170S has an opening contour that is substantially the same as a surface contour of the bottom surface of the conductive component to be formed. Note that in this embodiment, the opening contour of the front side opening 170F is the same as the opening contour of the back side opening 170S. In alternative embodiments, the aperture 174A may be provided in any shape and with a varying aspect ratio. As such, in alternative embodiments, the opening contour of the front side opening 170F and the opening contour of the back side opening 170S may be different in accordance with a desired shape for the conductive component.

With to the 3D inductor 62A shown in FIG. 3, the conductive component to be formed is the conductive via 70 at the vertical level 76(4T). In this case, the aperture 174A is shaped as the conductive via 70 (shown in FIG. 3), and the section 172A that is exposed by the aperture 174A is shaped as the via attachment surface 86U (shown in FIG. 4B). The mask 156 is positioned such that the aperture 174A is aligned with the section 172A of the plating foil 132. The section 172A is on the winding end surface section 84T (shown in FIG. 4B) provided by the winding surface 80T (shown in FIG. 4B) of the winding end 82F (shown in FIG. 3) of the winding 68 at the vertical level 76(M). The opening contour of the front side opening 170F of the mask 156 is thus substantially the same as the via attachment surface 86U (shown in FIG. 4B) of the conductive via 70 (shown in FIG. 3). The opening contour of the back side opening 170S of the mask 156 is thus substantially the same as the surface contour 88T (shown in FIG. 4A) of via attachment surface 86T (shown in FIG. 4A).

With regard to the 3D inductor 62B shown in FIG. 6, the conductive component to be formed is the conductive via 102 at the vertical level 76(4T) of one of the columns 100. Note that the mask 156 includes other apertures (not explicitly shown in FIG. 7J) that expose other sections of the plating foil so as to form the other three conductive vias 102 in the other columns at the vertical level 76(4T), as shown in FIG. 5. In this case, the aperture 174A is shaped as the conductive via 102T (shown in FIG. 6), and the section 172A that is exposed by the aperture 174A is shaped as the via attachment surface 124U (shown in FIG. 6) of the conductive via 102T in FIG. 6. In this case, the section 172A forms the via attachment surface 124T of the conductive via 102U at the vertical level 76(M). The aperture 174A is thus substantially aligned with the via attachment surface 124T of the conductive via 102 at the 76(M). The opening contour of the front side opening 170F of the mask 156 is thus substantially the same as the via attachment surface 124U of the conductive via 102T in FIG. 7J. The opening contour of the back side opening 170S of the mask 156 is thus substantially the same as the via attachment surface 124T of the conductive via 102U in FIG. 7J.

Next, a conductive material is plated on the first portion 158 of the plating foil 132 exposed by the mask 154, and a conductive material is plated on the first portion 162 of the plating foil 152 exposed by the mask 156 (FIG. 7K). Thus, the conductive material fills the apertures 168, 174 to form the conductive components (referred to generically as conductive components 176 and specifically as conductive components 176A-176B and referred to generically as conductive components 178 and specifically as conductive components 178A-178B) of the vertical levels 76(4B), 76(4T). Thus, plating the section 166A, 172A and filling the apertures 168A, 174A with the conductive material forms a conductive component 176A, 178A of the 3D inductor. For example, the conductive material may be a metallic material. Plating may be performed through either an electrolytic or an electroless plating process. In one implementation, the conductive material is copper (Cu) and plating is performed through an electrolytic copper (Cu) plating process or an electroless copper (Cu) plating process.

The conductive component 176A has a bottom component surface 180U and a top component surface 180T. The conductive component 176A is thus shaped as the aperture 168A. With regard to the 3D inductor 62A, the top component surface 180T provides the via attachment surface 86T (shown in FIG. 4A) of the conductive via 70 (shown in FIG. 3) at the vertical level 76(4B). The top component surface 180T is attached to the bottom component surface 148U of the winding 68 at the vertical level 76(M) and more particularly the winding end 82F (shown in FIG. 4A). As a result of the opening contour of the front side opening 170F, the top component surface 180T has the via surface contour 88T (shown in FIG. 4A) of the conductive via 70 (shown in FIG. 3) at the vertical level 76(4B) with the exterior edge contour 90T (shown in FIG. 4A) that is substantially the same as and substantially aligned with the same as the exterior edge contour 92U (shown in FIG. 4A) of the winding end 82F (shown in FIG. 4A). As a result of the opening contour of the back side opening 170S, the bottom component surface 180U has the via surface contour 88U (shown in FIG. 4B) of the conductive via 70 (shown in FIG. 3) at the vertical level 76(4B) with the exterior edge contour 90B (shown in FIG. 4B) that is substantially the same as and substantially aligned with the exterior edge contour 92T (shown in FIG. 4B) of the winding end 82S (shown in FIG. 4B) that is to be formed at the vertical level 76(3B).

With regard to the 3D inductor 62B, the top component surface 180T provides the via attachment surface 124T (shown in FIG. 5) of the conductive via 102U (shown in FIG. 5) at the vertical level 76(4B). As a result of the opening contour of the front side opening 170F, the top component surface 180T has the via surface contour 126T (shown in FIG. 5) of the conductive via 102U (shown in FIG. 5) at the vertical level 76(4B) that is substantially the same as and substantially aligned with the same as the via surface contour 126U (shown in FIG. 5) of the via attachment surface 124U (shown in FIG. 5) of the conductive via 102T (shown in FIG. 5) at the vertical level 76(M). As a result of the opening contour of the back side opening 170S, the bottom component surface 180U has the via surface contour 126U (shown in FIG. 5) of the via attachment surface 124U of the conductive via 102T (shown in FIG. 3) that is to be formed at the vertical level 76(3B).

The conductive component 178A has a top component surface 182T and a bottom component surface 182U. With regard to the 3D inductor 62A, the bottom component surface 182U provides the via attachment surface 86U (shown in FIG. 4B) of the conductive via 70 (shown in FIG. 3) at the vertical level 76(4T). The bottom component surface 180U is attached to the bottom component surface 148U of the winding 68 at the vertical level 76(M) and more particularly the winding end 82S (shown in FIG. 4B). As a result of the opening contour of the front side opening 174F, the bottom component surface 182U has the via surface contour 88U (shown in FIG. 4B) of the conductive via 70 (shown in FIG. 3) at the vertical level 76(4T) with the exterior edge contour 90U (shown in FIG. 4B) that is substantially the same as and substantially aligned with the same as the exterior edge contour 92T (shown in FIG. 4B) of the winding end 82S (shown in FIG. 4B) at the vertical level 76(M). As a result of the opening contour of the back side opening 170S, the top component surface 182T has the via surface contour 88T (shown in FIG. 4A) of the conductive via 70 (shown in FIG. 3) at the vertical level 76(4T) with the exterior edge contour 90B (shown in FIG. 4A) that is substantially the same as and substantially aligned with the exterior edge contour 92U (shown in FIG. 4A) of the winding end 82F (shown in FIG. 4A) that is to be formed at the vertical level 76(3T) (shown in FIG. 3).

With regard to the 3D inductor 62B, the top component surface 182T provides the top surface of the conductive via 102U (shown in FIG. 6) at the vertical level 76(4T). The bottom component surface 182U provides the via attachment surface 124U (shown in FIG. 5) of the conductive via 102T (shown in FIG. 5) at the vertical level 76(4T). The bottom component surface 182U is provided by the section 172A of the plating foil 152 and is integrated into the conductive component 178A. As a result of the opening contour of the front side opening 174F, the bottom component surface 182U has the via surface contour 126U (shown in FIG. 5) of the conductive via 102T (shown in FIG. 5) at the vertical level 76(4T) that is substantially the same as and substantially aligned with the same as the via surface contour 126T (shown in FIG. 5) of the via attachment surface 124T (shown in FIG. 5) of the conductive via 102U (shown in FIG. 5) at the vertical level 76(M). As a result of the opening contour of the back side opening 174S, the top component surface 182T has the via surface contour 126T (shown in FIG. 5) of the via attachment surface 124T of the conductive via 102U (shown in FIG. 3) that is to be formed at the vertical level 76(3T).

After plating, the masks 154, 156 (shown in FIG. 7K) are removed from the plating foil 132, 152 (FIG. 7L). The masks 154, 156 may be removed using a chemical etchant. As shown in FIG. 7L, the portion 160 of the plating foil 132 is exposed from the second vertical side SB after the mask 154 is removed and the portion 164 exposed from the first vertical side SA are removed. Next, the plating foil 132, 152 exposed after removing the masks 154,156 is removed to uncover the substrate layer surfaces 78T, 78U (FIG. 7M). As such, the portions 160, 164 of the plating foils 132, 152 are removed. Consequently, with respect to the 3D inductor 62A, the plating foils 132, 152 do not substantially extend past the exterior contours of the conductive vias do not extend past the exterior contours of the winding ends. With respect to the 3D inductor 62B, the plating foils 132, 152 do not substantially extend past the via attachment surfaces of the conductive vias. Next, substrate layers 66 at the vertical levels 76(4B), 76(4T) are provided to cover the substrate layer surface which are exposed after removing the plating foils 132, 152 and the conductive components 176, 178 (FIG. 7N). Segments 192, 194 of the substrate layers 66 at the vertical levels 76(4B), 76(4T) are removed through grinding, or the like, to expose the component surfaces 180U, 182T (FIG. 7O).

Steps described above may be repeated in order to form the conductive components 200A, 200B, 202A, 202B, 204A, 204B, 206A, 206B, 208A, 208B, 210A, 210B, and substrate layers 66 on the vertical levels 76(3B), 76(2B), 76(1B), 76(3T), 76(2T), 76(1T) (FIG. 7P). Conductive components 212, 214 may then be formed on substrate surfaces 75, 196 to form terminals and or grounding plates (FIG. 7Q). Note that the plating foils 132, 152 may be about 1 micrometer. The remainder of the conductive components, such as the conductive components 146, 176, 178 may be approximately 50 micrometers in thickness or in depth (depending on the type of conductive component). As such, when the conductive component 146 is the winding 68, the thickness of the winding is approximately 50 micrometers. When the conductive component 146 is the conductive via 102, the depth of the conductive via 102 is approximately 50 micrometers. The conductive components 176, 178 are conductive vias (either conductive vias 70 or the conductive vias 102) and each has a depth of approximately 50 micrometers. Thus, the thickness of the winding 68 is approximately the same as the depth of each of the conductive vias 70. The depth of the conductive vias 102 are each the same also.

Those skilled in the art will recognize improvements and modifications to the preferred embodiments of the present disclosure. All such improvements and modifications are considered within the scope of the concepts disclosed herein and the claims that follow.

What is claimed is:

1. A substrate comprising:

a substrate body; and a three dimensional (3D) inductor integrated into the substrate body, wherein the 3D inductor comprises:

a first vertical interconnect access structure (via) having a first via attachment surface that defines a first via surface contour;

a first plating foil integrated into the first via to provide a second via attachment surface that is opposite the first via attachment surface and defines a second via surface contour;

a first winding having a first winding end;

a second plating foil integrated into the first winding to provide a first winding surface, wherein:

the first winding surface includes a first winding end surface section that defines an exterior edge contour of the first winding end; and the first winding end surface section is directly attached to the first via attachment surface such that an exterior edge contour of the first winding end surface section is substantially aligned with and is substantially the same as an exterior edge contour of the first via surface contour; and a second winding having a second winding end and a second winding surface wherein the second winding end has a second winding end surface section provided by the second winding surface, wherein:

the second winding end surface section is attached to the second via attachment surface such that an exterior edge contour of the second winding end surface section is substantially aligned with and is substantially the same as an exterior edge contour of the second via surface contour; and the first winding and the second winding are substantially aligned around a common axis, such that current is able to propagate through the first winding and the second winding in a same rotational direction.

2. The substrate of claim 1 wherein:

the 3D inductor further comprises a third plating foil integrated into the second winding to provide a third winding surface opposite the second winding surface; and the second winding further comprises a third winding end opposite the second winding end, wherein the third winding surface includes a third winding end surface section that defines an exterior edge contour of the third winding end.

3. The substrate of claim 2 further comprising a second via having a third via attachment surface that defines a third via surface contour, wherein the third winding end surface section is attached to the third via attachment surface such that an exterior edge contour of the third winding end surface section is substantially aligned with and is substantially the same as an exterior edge contour of the third via surface contour.

4. The substrate of claim 3 wherein:

the first via has a first depth;

the second via has a second depth;

the first winding has a first thickness;

the second winding has a second thickness; and wherein the first depth of the first via, the second depth of the second via, the first thickness of the first winding, and the second thickness of the second winding are substantially equal.

5. The substrate of claim 4 wherein the first depth of the first via, the second depth of the second via, the first thickness of the first winding, and the second thickness of the second winding are each approximately 50 micrometers.

6. The substrate of claim 1 wherein:

the first via has a first depth;

the first winding has a first thickness;

the second winding has a second thickness; and wherein the first depth of the first via, the first thickness of the first winding, and the second thickness of the second winding are substantially equal.

7. The substrate of claim 6 wherein the first depth of the first via, the first thickness of the first winding and the second thickness of the second winding are each approximately 50 micrometers.

8. The substrate of claim 1 comprising a plurality of windings and a plurality of vias, wherein the plurality of windings includes the first winding and the second winding, and the plurality of vias includes the first via.

9. The substrate of claim 8 wherein each of the plurality of windings has a thickness and each of the plurality of vias has a depth wherein the thickness of each of the plurality of windings and the depth of each of the plurality of vias are substantially the same.

10. The substrate of claim 9 wherein the depth of each of the plurality of vias and the thickness of each of the plurality of windings is approximately 50 micrometers.

11. The substrate of claim 1 wherein the first winding and the second winding are circular.

12. The substrate of claim 1 wherein a thickness of the first plating foil is approximately 1 micrometer, and a thickness of the second plating foil is approximately 1 micrometer.

13. The substrate of claim 2 wherein a thickness of the first plating foil is approximately 1 micrometer, a thickness of the second plating foil is approximately 1 micrometer, and a thickness of the third plating foil is approximately 1 micrometer.

* * * * *